US007280047B2

(12) United States Patent
Giles et al.

(10) Patent No.: US 7,280,047 B2
(45) Date of Patent: Oct. 9, 2007

(54) REAL-TIME ELECTRONIC SPRAY DEPOSITION SENSOR

(75) Inventors: D. Ken Giles, Davis, CA (US); Trevor Crowe, Saskatchewan (CA)

(73) Assignee: The Regents of the University of California, Oakland, CA (US)

( * ) Notice: Subject to any disclaimer, the term of this patent is extended or adjusted under 35 U.S.C. 154(b) by 185 days.

(21) Appl. No.: 11/124,429

(22) Filed: May 5, 2005

(65) Prior Publication Data

US 2006/0261963 A1 Nov. 23, 2006

(51) Int. Cl.
*G08B 21/20* (2006.01)
*B05B 1/24* (2006.01)

(52) U.S. Cl. ..... 340/604; 239/13; 239/63; 239/69; 137/78.3

(58) Field of Classification Search ..... 340/602, 340/604, 605; 73/170.19; 239/13, 63, 69; 137/78.3
See application file for complete search history.

(56) References Cited

U.S. PATENT DOCUMENTS 4,466,481 A * 8/1984 Wilson et al. ..... 165/70
4,665,351 A * 5/1987 Nyberg ..... 318/483
4,827,198 A 5/1989 Mueller et al.
4,831,493 A 5/1989 Wilson et al.
4,965,554 A * 10/1990 Darling ..... 340/604
5,081,422 A * 1/1992 Shih ..... 324/693
5,192,932 A * 3/1993 Schwab, Jr. ..... 340/604
5,313,072 A 5/1994 Vachss
5,341,831 A * 8/1994 Zur ..... 137/78.3
5,354,015 A * 10/1994 Meador ..... 244/134 F
5,523,959 A * 6/1996 Seegmiller ..... 702/130
5,533,391 A * 7/1996 Brade et al. ..... 73/170.19
5,668,478 A 9/1997 Buschur
5,748,092 A * 5/1998 Arsenault et al. ..... 340/604
5,823,849 A * 10/1998 Gardner et al. ..... 446/473
6,144,022 A 11/2000 Tenenbaum et al.
6,281,801 B1 * 8/2001 Cherry et al. ..... 340/605
6,731,215 B2 5/2004 Harms et al.
6,768,422 B2 7/2004 Schofield et al.
6,841,767 B2 1/2005 Mindl et al.
6,853,897 B2 2/2005 Stam et al.
6,995,676 B2 * 2/2006 Amacher ..... 340/602
7,030,727 B2 * 4/2006 Nagaoka et al. ..... 338/160
7,143,654 B2 * 12/2006 Raffle et al. ..... 73/820

(Continued)

OTHER PUBLICATIONS

R.D. Fox, M. Salyani, J.A. Cooper, R.D. Brazee. Spot size comparisons on oil and water sensitive paper. Applied Eng. Agric., vol. 17 No. 2, pp. 131-136 (2001).

(Continued)

*Primary Examiner*—Jeffery Hofsass
*Assistant Examiner*—Anne V. Lai
(74) *Attorney, Agent, or Firm*—John P. O'Banion

(57) ABSTRACT

An electronic spray deposition sensor for sensing deposition of liquid on an exterior surface is disclosed. The deposition sensor has a sensing surface comprising a plurality of electrically conductive elements disposed across the sensing surface. The conductive elements are closely spaced apart from each other and insulated from each other on the sensing surface. A comparator circuit is coupled to the conductive elements to detect the presence of liquid at the conductive element. In particular, conductive elements are disposed in an array across the sensing surface such that the presence and location of the liquid on the sensing surface may be determined.

34 Claims, 15 Drawing Sheets

U.S. PATENT DOCUMENTS

2005/0242205 A1* 11/2005 Jarvis ..... 239/71
2006/0145879 A1* 7/2006 Stackelhouse ..... 340/604

OTHER PUBLICATIONS

D.K. Giles, D. Downey. Quality control verification and mapping for chemical application. Prec. Agric., vol. 4, 103-124 (2003).

R.E. Wolf, Assessing the ability of Dropletscan to analyze spray droplets from a ground operated sprayer. Applied Eng. Agric., vol. 19, No. 5, pp. 525-530 (2003).

A.R. Womac, C.W. Smith, J.E.Mulrooney. Foliar spray bandingcharacteristics. Trans. ASAE, vol. 47, No. 1, pp. 37-44 (2004).

J.M. Stonehouse. A camera mount for the photography of spray tracer deposits in the field. J. Agric. Eng. Res., vol. 47, pp. 207-211 (1990).

J.M. Babcock, J.J. Brown, L.K. Tanigoshi. Volume and coverage estimation of spray deposition using amino nitrogen colorimetric reaction. J. Econ. Entomology, vol. 83, No. 4, pp. 1633-1635 (1990).

A. Weiss, D.L. Lukens, J.R. Steadman. A sensor for the direct measurement of leaf wetness: construction techniques and testing under controlled conditions. Argic. & Forest Meterology, vol. 43, Nos. 3-4, pp. 241-249 (1988).

L.J. Giesler, G.L. Horst, G.Y. Yuen. A site-specific sensor for measuring leaf wetness duration within turfgrass conopies. Argic. & Forest Meterology, vol. 81, Nos. 1-2, pp. 145-154 (1996).

D.R. Davis and Jerrell E. Hughes. A new approach to recording the wetting parameter by use of electrical resistance sensors. Plant Disease Reporter, vol. 54, pp. 373-479 (1970).

R.A.C. Miranda, T.D. Davies, Sarah E. Cornell. A laboratory assessment of wetness sensors for leaf, fruit and trunk surfaces. Agric. & Forest Meterology, vol. 102, No. 4, pp. 263-274 (2000).

Robert C. Maze, Kishor T. Parekh. Sensor for measuring low volume spray deposit. Presented at the 1993 ASAE/CSAE International Summer Meeting, Spokane, Washington, Jun. 20-23, 1993, Paper No. 93-1002.

M. Salvani, J. Serdynski. Development of a sensor for spray deposition assessment Transactions of the ASAE, vol. 33, No. 5, pp. 1464-1468 (1990).

American Society of Agricultural Engineers. Standard: Spray Nozzle Classification by Droplet Spectra. ASAE S572 FEB04.

Campbell Scientific, Inc. Model 237: Leaf Wetness Sensor. Specification and Manual. Revision Jun. 1996.

R.C. Derksen, C.Jiang. Automated detection of fluorescent spray deposits with a computer vision system. Transactions of the ASAE, vol. 38, No. 6, pp. 1647-1653 (1995).

Daniel K. Fisher, Marvin L. Stone, Ronald L. Elliott. Design and testing of a leaf-wetness sensor. Presented at the 1992 ASAE International Winter Meeting, Nashville, Tennessee, Dec. 15-18, 1992, Paper No. 923545.

R.D. Fox, R.C. Derksen, J.A. Cooper, C.R. Krause, H.E. Ozkan. Visual and image system measurement of spray deposits using water-sensitive paper. Applied Eng. Agric., vol. 19, No. 5, pp. 549-552 (2003).

E. Franz, L.F. Bouse, J.B. Carlton, I.W.Kirk, M.A.Latheef. Aerial spray deposits relations with plant canopy and weather parameters. Transactions of the ASAE, vol. 41, No. 4, pp. 959-966 (1998).

T.J. Gillespie, G.E. Kidd. Sensing duration of leaf moisture retention using electrical impedance grids. Can. J. Plant Sci., vol. 58, pp. 179-187 (1978).

H. Griffioen, J.G. Kornet, K. Schurer. An optical leaf wetness sensor. Acta Horticulturae, vol. 304, pp. 127-135.

B.D. Hill, D.J. Inaba. An impingement plate method to detect aerial deposits of chloropyrifos. J. Environ. Sci. Health, vol. B25, No. 4, pp. 415-432 (1990).

P.K. Jensen, N.H. Spliid. Deposition of spray liquid on the soil below cereal crops after applications during the growing season. Weed Research, vol. 43, pp. 362-370 (2003).

Y.F. Lau, M.L. Gleason, N. Zriba, S.E. Taylor, P.N. Hinz. Effects of coating, deployment angle, and compass orientation on performance of electronic wetness sensors during dew periods. Plant Dis., vol. 84, pp. 192-197 (2000).

A.Z. Macnichol, M.E. Teske, J.W.Barrie. A technique to characterize spray deposit in orchard and tree canopies. Transactions of the ASAE, vol. 40, No. 6, pp. 1529-1536 (1997).

B. Panneton. Images analysis of water-sensitive cards for spray coverage experiments. Applied Eng. Agric., vol. 18, No. 2, pp. 179-182 (2002).

Ido Seginer, Igor Zlochin. Night-time greenhouse humidity control with a cooled wetness sensor. Agric. & Forest Meterology, vol. 85, pp. 269-277 (1997).

Alam Sundaram, Kanth M.S. Sundaram. A high-performance liquid chromatographic method to determine spreading and penetration of glyphosate spray droplets in some samplers used in forestry. J. Environ. Sci. Health, vol. B30, No. 1, pp. 49-72 (1995).

J.R.M. Thacker, F.R. Hall. The effects of drop size and formulation upon the spread of pesticide droplets impacting on water-sensitive papers. J. Environ. Sci. Health, vol. B26, Nos. 5-6, pp. 631-651 (1991).

* cited by examiner

REAL-TIME ELECTRONIC SPRAY DEPOSITION SENSOR

CROSS-REFERENCE TO RELATED APPLICATIONS

Not Applicable.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C. F. R. § 1.14.

BACKGROUND OF THE INVENTION

1. Field of the Invention

This invention pertains generally to electronic spray deposition sensors, and more particularly to electronic spray deposition sensors having a sensor array.

2. Description of Related Art

There has been considerable previous research on spray deposition assessments for agricultural sprayers. Historically, spray deposition studies have relied on the use of water and oil sensitive paper to document deposition rates. This technique requires the placement, collection, scanning and post processing of stains on cards, and is time consuming and labor intensive.

However, the need to easily and accurately estimate spray efficiency, penetration of spray through a foliar canopy and uniformity of deposition over crop surfaces persists. Often, such as in worker exposure, pesticide residue assessments and efficacy studies, spray deposition must be quantified as mass of active ingredient per unit target area or mass. For these applications, the chemical or a tracer, such as a fluorescent tag, must be extracted from the target substrate or removed from the surface, then the solvent analyzed for the active ingredient. These chemical analyses can be costly and subject to errors from contamination and recovery problems. Moreover, they cannot always provide information on spatial distribution of deposition, droplet deposition density or the fraction of target area covered by the deposit.

An alternative to chemical analysis for quantifying spray deposition is the optical measurement of visual spray deposition. Such analysis can provide information on size spectra of droplet deposits, spatial uniformity of deposition and extent of deposition coverage. Optical contrast between spray deposit and target substrate can be achieved by addition of dyes and fluorescent tracers in the spray or use of a water sensitive paper (WSP) that reacts to deposition to form stains [Fox et al. (Fox, R. D., M. Salyani, J. A. Cooper and R. D. Brazee. 2001: Spot size comparisons on oil and water sensitive paper. Applied Eng. Agric. 17(2): 131-136), Giles and Downey (Giles, D. K. and Downey, D. 2003. Quality control verification and mapping for chemical application. Prec. Agric. 4:103-124), Wolf (Wolf, R. E. 2003. Assessing the ability of Dropletscan to analyze spray droplets from a ground operated sprayer. Applied Eng. Agric. 19(5):525-530), Womac et al. (Womac, A. R., C. W. Smith and J. E. Mulrooney. 2004. Foliar spray banding characteristics. Trans. ASAE 47(1):37-44)].

Use of water sensitive paper or other optical techniques for deposition studies involves setting, numbering, collecting, and post processing data manually, with image processing technology. The process is a tedious, meticulous and time-consuming task. An additional limitation of these techniques is that they do not provide real-time measurements. The target substrates, either plant material such as leaves, or artificial targets must be removed and analyzed, often days or weeks after the spray application.

A number of different sensor types have been used for spray deposition and for characterizing wetness patterns in agricultural production systems, such as greenhouses, including radiometric sensors [Stonehouse (Stonehouse, J. M. 1990. A camera mount for the photography of spray tracer deposits in the field. J. Agric. Eng. Res. 47:207-211), Babcock et al. (Babcock, J. M., J. J. Brown and L. K. Tanigoshi. 1990. Volume and coverage estimation of spray deposition using amino nitrogen calorimetric reaction. J. Econ. Entomology 83(4):1633-1635)], artificial surface sensors [Weiss et al. (Weiss, A., D. L. Lukens and J. R. Steadman. 1988. A sensor for the direct measurement of leaf wetness: Construction techniques and testing under controlled conditions*1. Agric. & Forest Meteorology, 43 (3-4), 241-249), Giesler et al. (Giesler, L. J., G. L. Horst and G. Y. Yuen. 1996. A site-specific sensor for measuring leaf wetness duration within turfgrass canopies. Agric. & Forest Meteorology, 81 (1-2), 145-156), Davis and Hughes (Davis and Hughes. 1970. A new approach to recording the wetting parameter by use of electrical resistance sensors. Plant Disease Reporter, 54:373-479)], and electronic (resistance) sensors [Miranda et al. (Miranda, R. A. C., T. D. Davies and Sarah E. Cornell. 2000. A laboratory assessment of wetness sensors for leaf, fruit and trunk surfaces. Agric. & Forest Meteorology, 102 (4), 263-274)]. Sensors give variable non-linear responses depending on the distribution and quantity of moisture present.

Even with the considerable research that has been documented to characterize spray deposition patterns from different sprayers and for different commodities, often times the spray effects are site or research technique specific, as analysis of WSP becomes subjective for the specific laboratory, and the scanning procedure is unique to the lab doing the spray deposition research. There are no developed standards for WSP analysis and many of the new developments continue to be essentially manual operations.

Accordingly, it is an object of the present invention to provide reusable, electronic liquid deposition sensor with automated data recovery.

A further object of the present invention is a real-time spray sensor to quantify and localize spray deposition in situ for agricultural spraying.

Another object of the present invention is an electronic deposition sensor that is capable of transmitting data, via a wireless network, to a local site or external receiver mounted in a mobile vehicle.

Yet a further object of the present invention is an electronic deposition sensor that calculates a grid pattern of the spray deposition within an entire field. At least some of these objectives will be met in the following description.

BRIEF SUMMARY OF THE INVENTION

A spray deposition measurement tool is disclosed having novel electrical sensor processing and monitoring to improve indication of uniformity and spray effectiveness, via real-time data, and therefore require less field time and allow more efficient data processing.

An aspect of the invention is an apparatus for sensing deposition of a liquid on an exterior surface. The apparatus has a sensing surface comprising a plurality of electrically conductive elements disposed across the sensing surface, wherein the conductive elements are closely spaced apart from each other and electrically insulated from each other on the sensing surface. Multiple comparator circuits are coupled to the conductive elements. Each comparator circuit is configured to detect the presence of liquid at the conductive element. Additionally, the conductive elements are disposed in an array across the sensing surface such that the location of the liquid on the sensing surface may be determined.

In one mode of the current aspect, the sensing surface comprises at least three conductive elements. The conductive elements are configured such that deposition of liquid across two of the conductive elements causes a change in voltage detectable by said comparator circuit, wherein the change in voltage signals the presence and location of liquid on said sensing surface.

In one embodiment, a microprocessor is coupled to the conductive elements and the comparator circuit. The microprocessor is configured to scan the conductive elements for deposition of liquid at the conductive elements.

In another embodiment, a display is coupled to the microprocessor. The display is responsive to output from said microprocessor to indicate the presence and location of liquid at said conductive elements.

In one variation of the current embodiment, the display comprises a plurality of LEDs, each LED corresponding to output from a conductive element. The LED illuminates as a result of liquid deposition at the conductive element. Preferably, the LEDs are arranged in an array such that the location of each LED corresponds to a location of the conductive element.

Alternatively, the display may comprise a monitor, CRT, LCD or other display commonly known in the art.

In one embodiment, the conductive elements comprise a plurality of sensing pads electrically connected to the comparator circuit, and a plurality of excitation pads each supplied with a voltage, such that deposition of water across one of the plurality of sensing pads and one of the plurality of excitation pads results in a change in voltage detectable by the comparator circuit. In one variation, the sensing pads and the excitation pads are arranged in alternative rows.

In another embodiment, the comparator circuit is supplied with a reference voltage. Preferably, the reference voltage may be varied to control the sensitivity of the comparator circuit.

In another mode, a transmitter may be coupled to the microprocessor. The transmitter is configured to transmit signals of the sensing surface to a remote unit, wherein the remote unit has a receiver adapted to receive the signals from said transmitter. In some embodiments, the remote unit is configured to receive signals from a plurality of sensing surfaces. Additionally, the remote unit may be configured to display real-time output from said sensing surface.

In another aspect of the present invention, a method of detecting liquid on a sensor surface is disclosed. The method includes the steps of supplying voltage to at least a first portion of a plurality of electrically conductive elements disposed across the sensor surface, checking at least a portion of the conductive elements for the presence of liquid deposition at the conductive elements, and displaying the location of a conductive element having water deposition.

In one mode of the current aspect, a second portion of the plurality of conductive elements are not supplied voltage such that checking at least a portion of the conductive elements comprises checking the second portion of conductive elements.

In one embodiment, checking the second portion of conductive elements comprises checking a voltage of the second portion of the conductive elements with a comparator circuit.

In another embodiment, checking a voltage of the second portion of the conductive elements comprises comparing a voltage input from a conductive element with a reference voltage supplied to the comparator circuit. In such an embodiment, the method may further comprise controlling the value of the reference voltage to adjust the sensitivity of the sensor surface.

In yet another embodiment, the sensor surface is configured such that deposition of liquid across one of the first portion of conductive elements and one of the second portion of conductive elements results in a change in voltage detectable by the comparator circuit.

In a further embodiment, the method also includes supplying voltage to a third portion of the plurality of conductive elements after discontinuing power to the first portion of conductive elements. The sensor surface is configured such that deposition of liquid across one of the third portion of conductive elements and one of the second portion of conductive elements results in a change in voltage detectable by the comparator circuit.

In another mode of the current aspect, checking at least a portion of the conductive elements comprises scanning the portion of conductive elements with a microprocessor.

In a further mode, displaying the location of a conductive element having water deposition further comprises displaying a map of the plurality of conductive elements, the map comprising the locations of at least a portion of the conductive elements. This may be achieved by illuminating a portion of the display to illustrate the presence of water deposition at the conductive element, the illuminated portion of the display corresponding to the location of the conductive element.

In yet another mode, the method may further include transmitting a signal from the sensor surface to a remote unit, wherein the location of a conductive element having water deposition is displayed at the remote unit. Generally, the signal is transmitted via a wireless transmitter such as an RF or IR transmitter. Additionally, a second signal from a second sensor surface spaced apart from the first sensor surface may be transmitted to the remote unit, such that output from the second sensor surface is displayed at the remote unit.

In a further aspect of the invention, an electronic spray deposition sensor, includes a sensing surface having a plurality of electrically conductive elements disposed in an array across the sensing surface, and means for monitoring the plurality of conductive elements to determine the presence and location of deposition of liquid on the sensing surface.

In one mode of the current aspect, the means for monitoring the plurality of conductive elements comprises means for supplying voltage to at least a portion of the plurality of conductive elements, and means for checking the voltage of at least a portion of the plurality the conductive elements.

In a preferred embodiment, the means for checking the voltage of the conductive elements comprises a microprocessor and a comparator circuit.

In addition, the deposition sensor may further include means for displaying output from the sensor surface. In some embodiments, the means for displaying output from the sensor surface comprises means for mapping the location of liquid deposition across the sensor surface.

In one mode of the current aspect, the sensor may further include means for transmitting an output signal from the sensor surface to a remote location. In addition, the sensor may have means for displaying the output signal from the sensor surface at the remote location.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

Figure 1A:
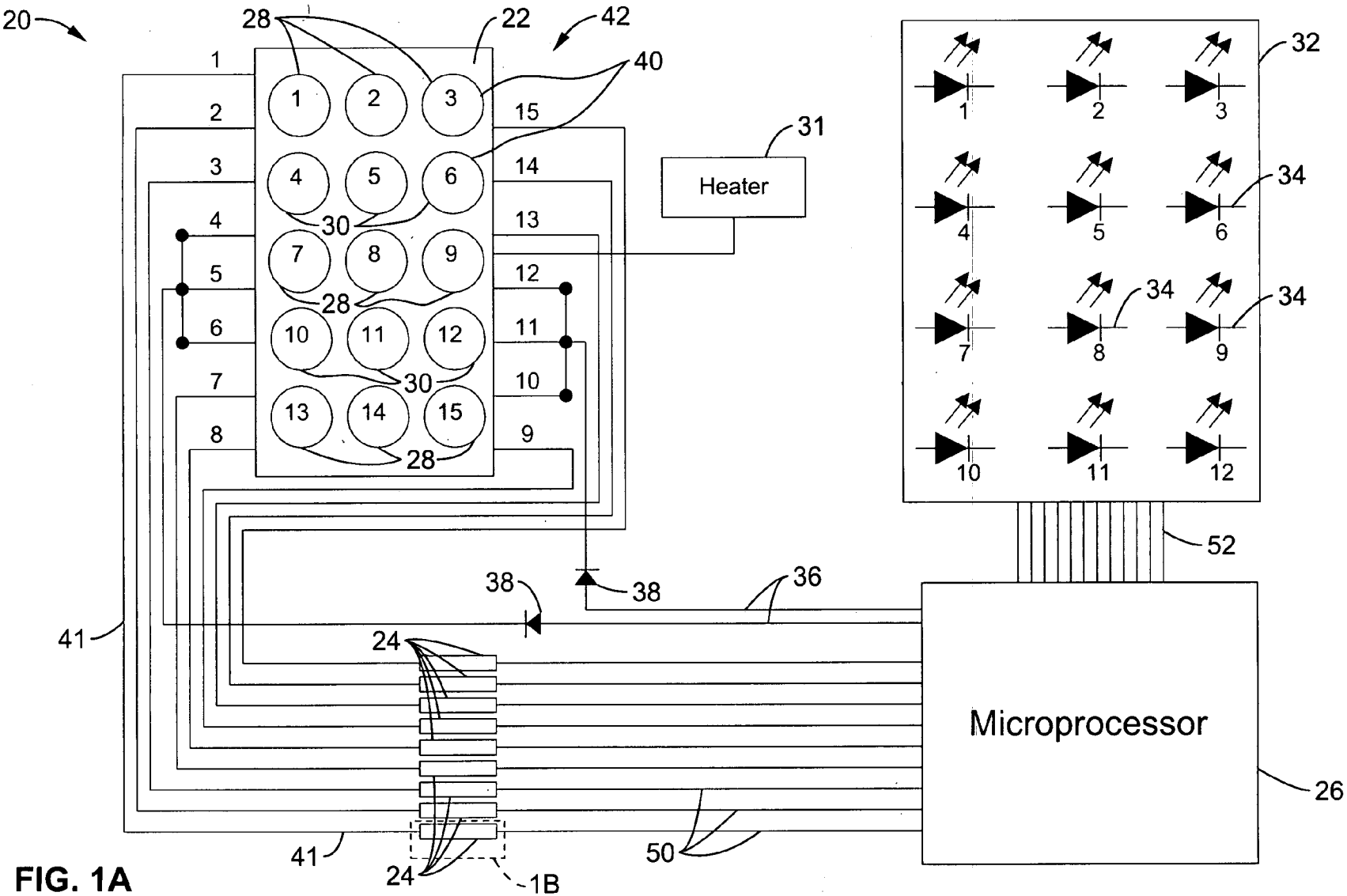
FIG. 1A is a block diagram of the sensing system of the present invention.
Figure 10A:
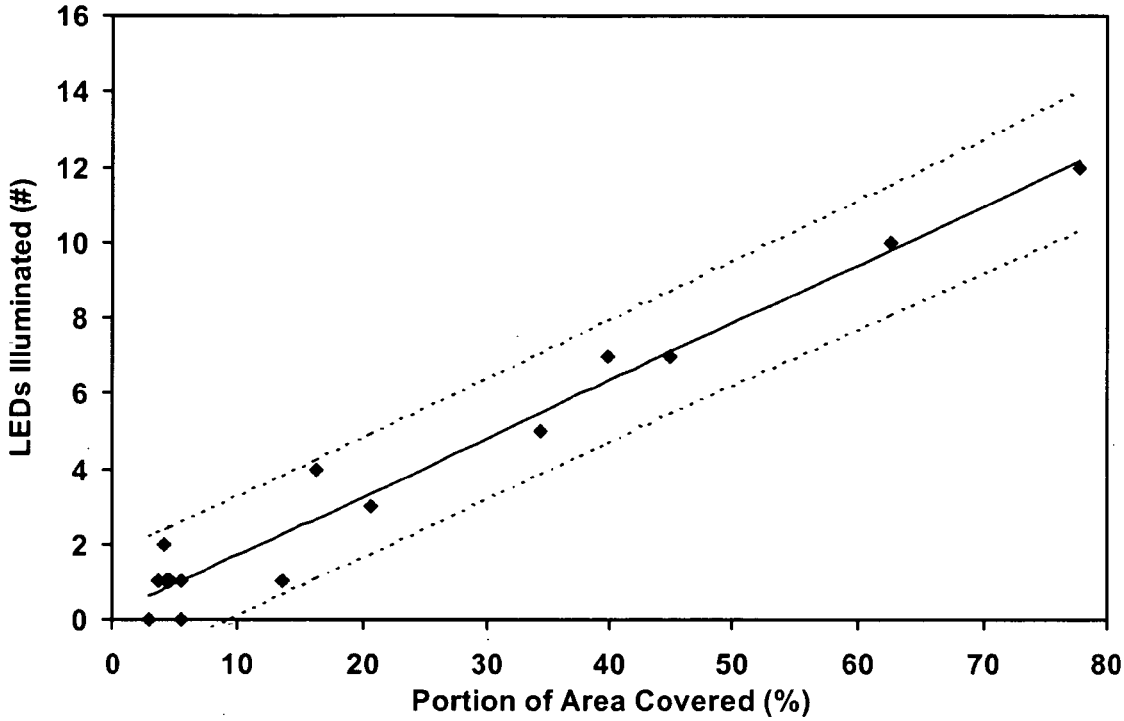
Figure 10B:
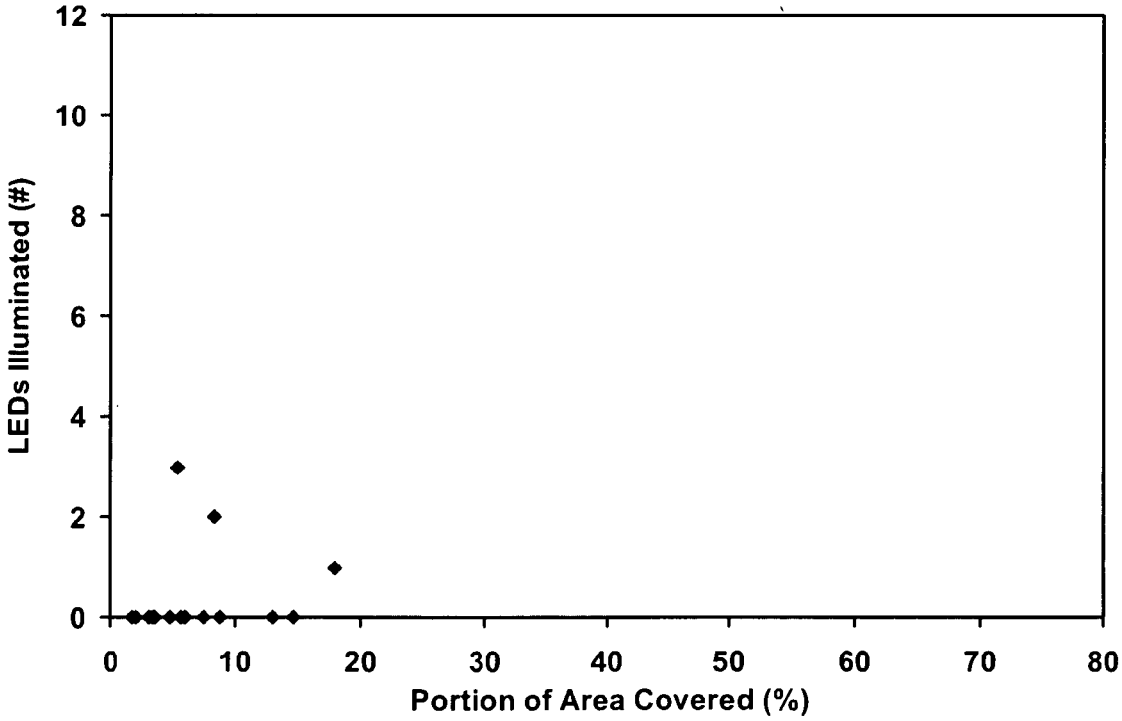
Figure 10C:
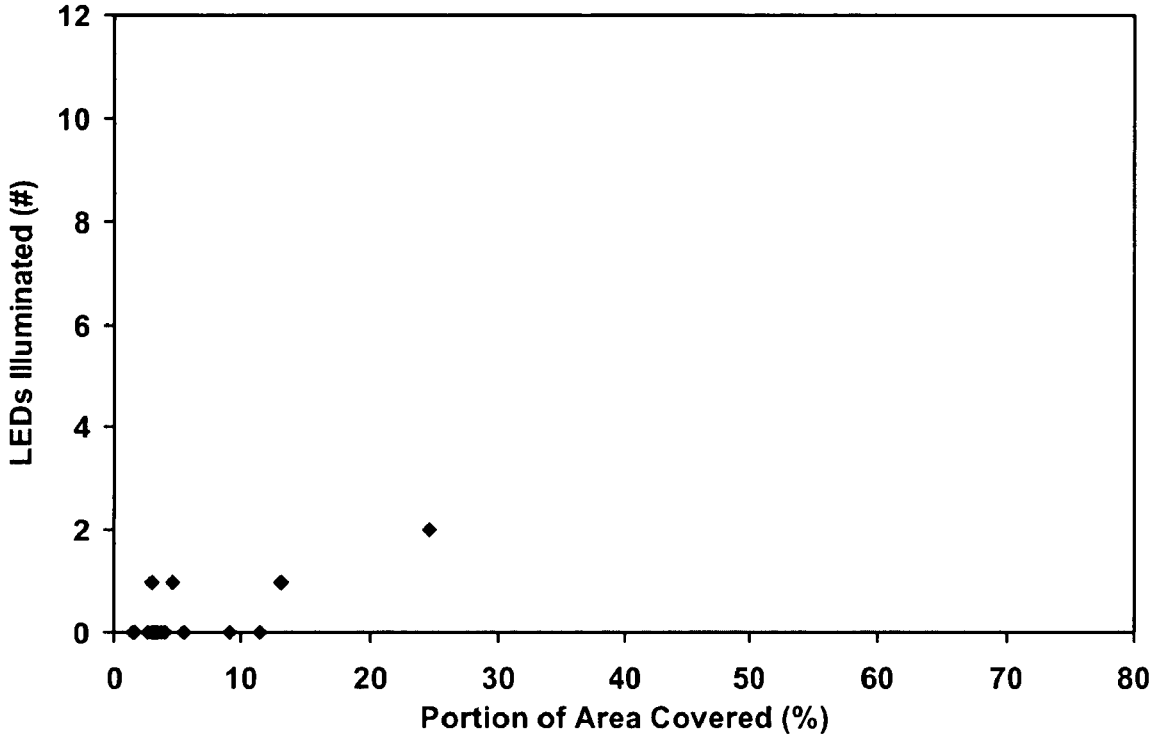

FIG. 10A-C show the combined responses of the sensor after single and multiple applications, with the comparator reference voltage set at 0.25 V, with FIG. 10A showing results with a course (8008 nozzle), FIG. 10B showing results with a medium (11006 nozzle), and FIG. 1C showing results with a fine (11003 nozzle). In FIG. 10A, the solid line represents the fitted equation, and the dashed lines represent 95% confidence limits.

Figure 11A:
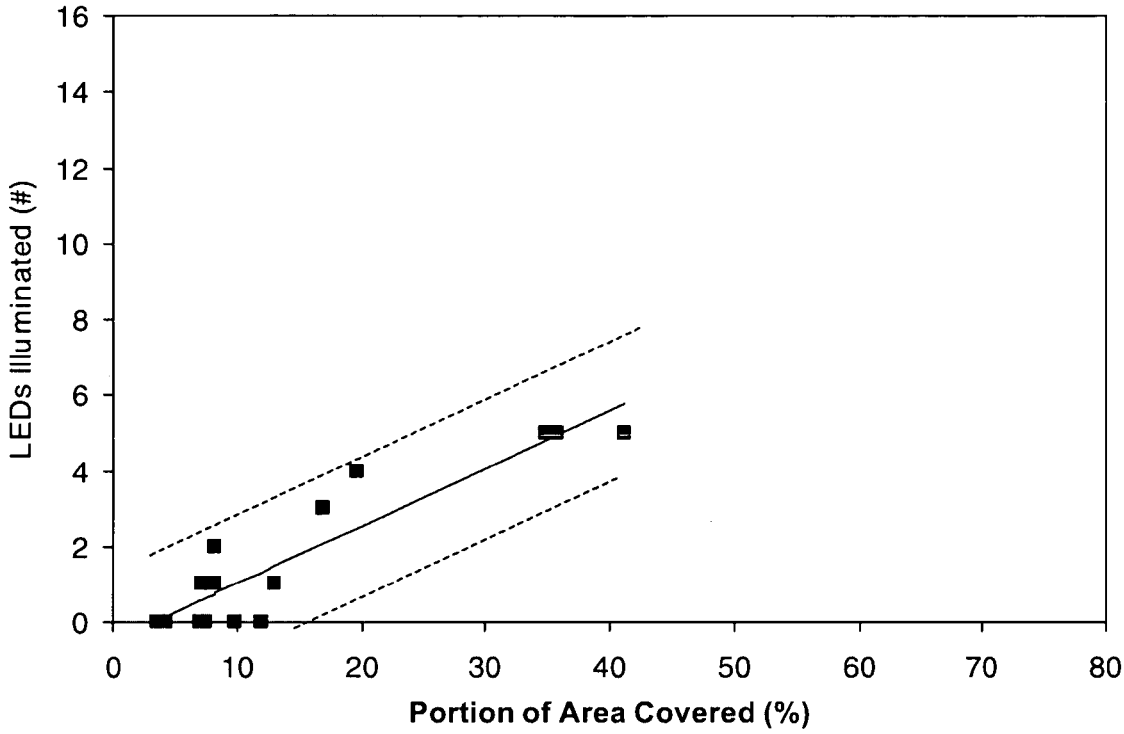
Figure 11B:
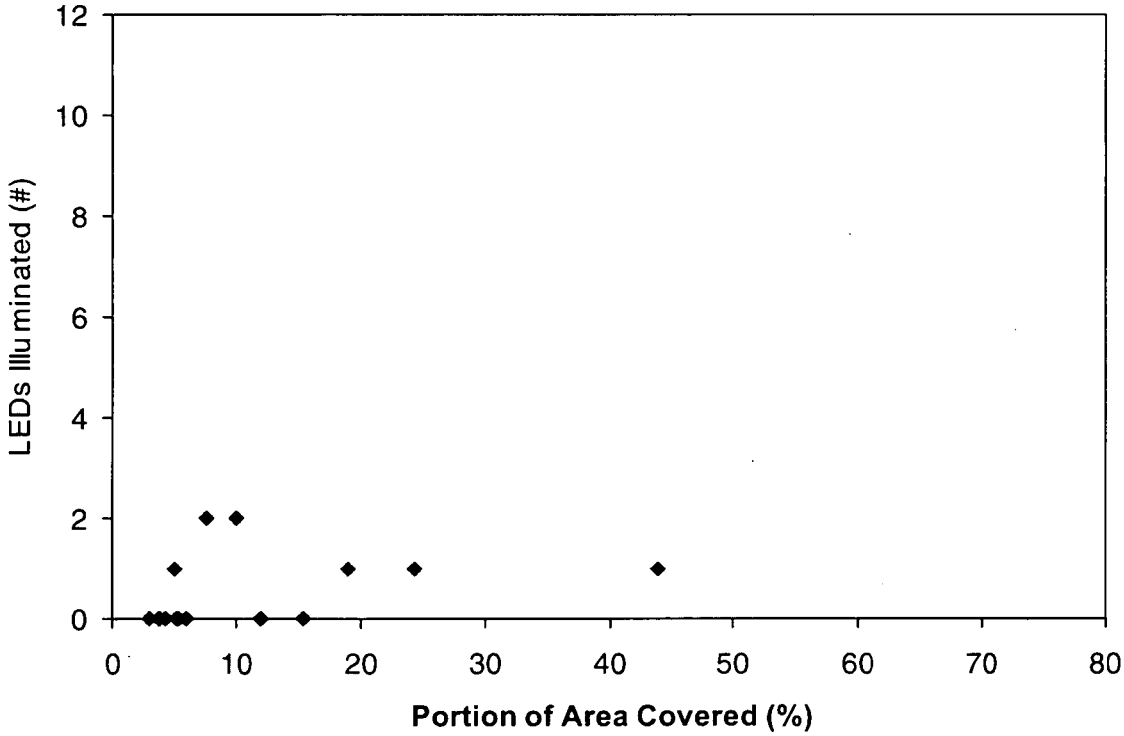
Figure 11C:
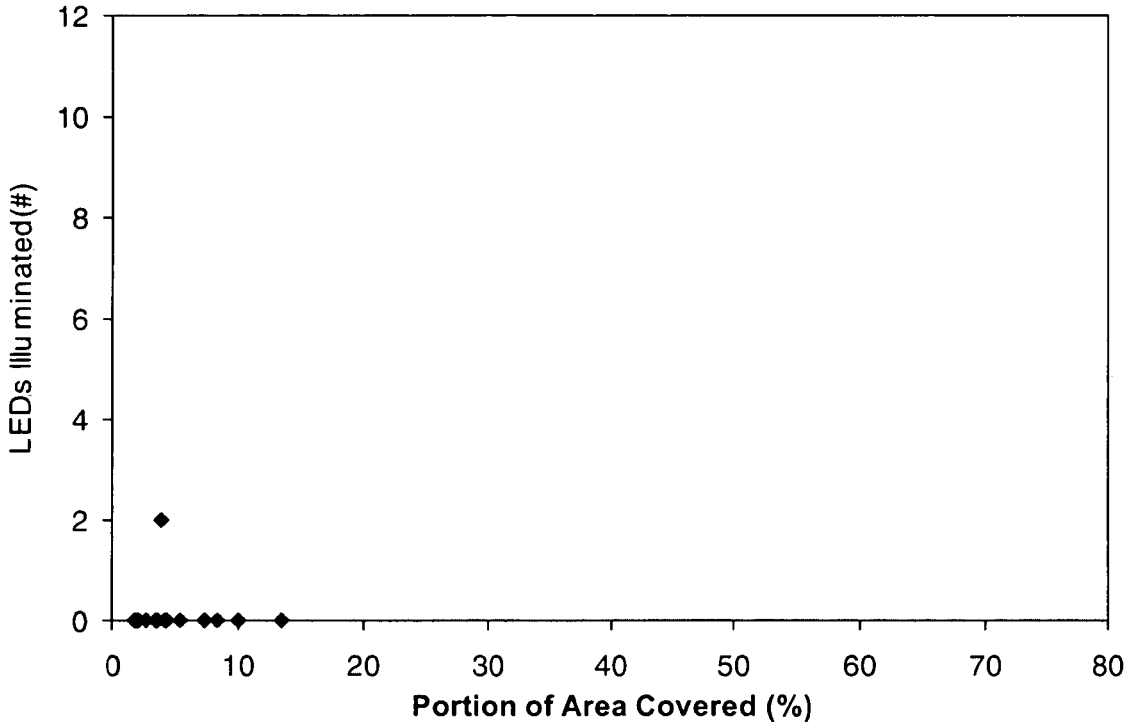

FIG. 11A-C shows the combined responses of the sensor after single and multiple applications, with the comparator reference voltage set at 0.5 V, with FIG. 11A showing results with a course (8008 nozzle), FIG. 11B showing results with a medium (11006 nozzle), and FIG. 11C showing results with a fine (11003 nozzle). In FIG. 11A, the solid line represents the fitted equation, and the dashed lines represent 95% confidence limits.

Figure 12:
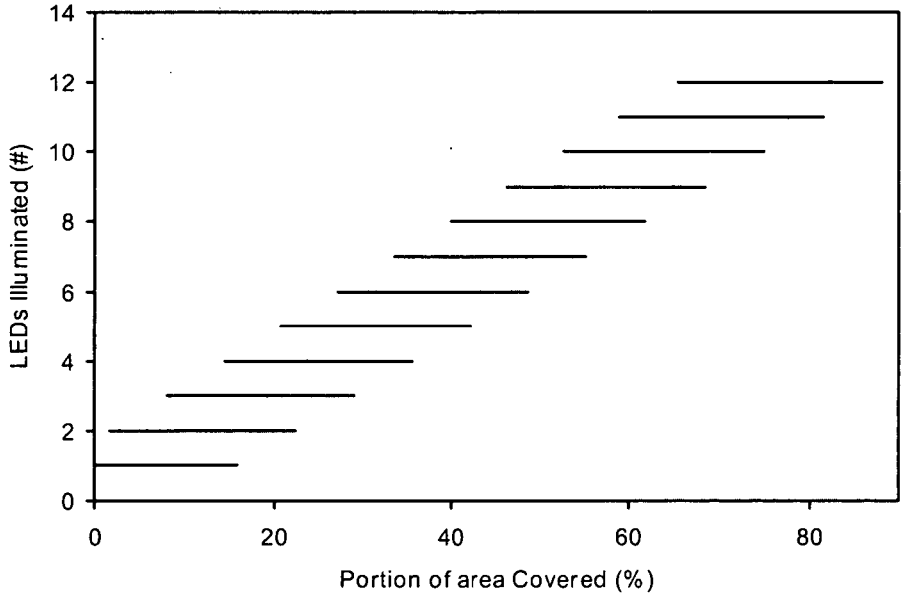

FIG. 12 illustrates a theoretical spray deposition model derived from an abundance of data.

Figure 13A:
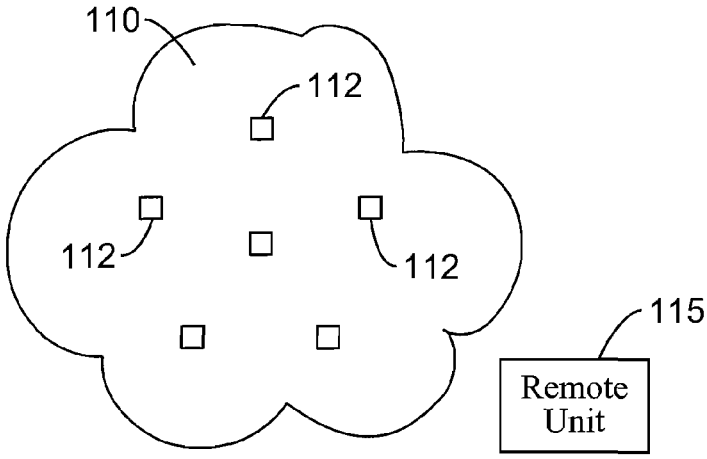
Figure 13B:
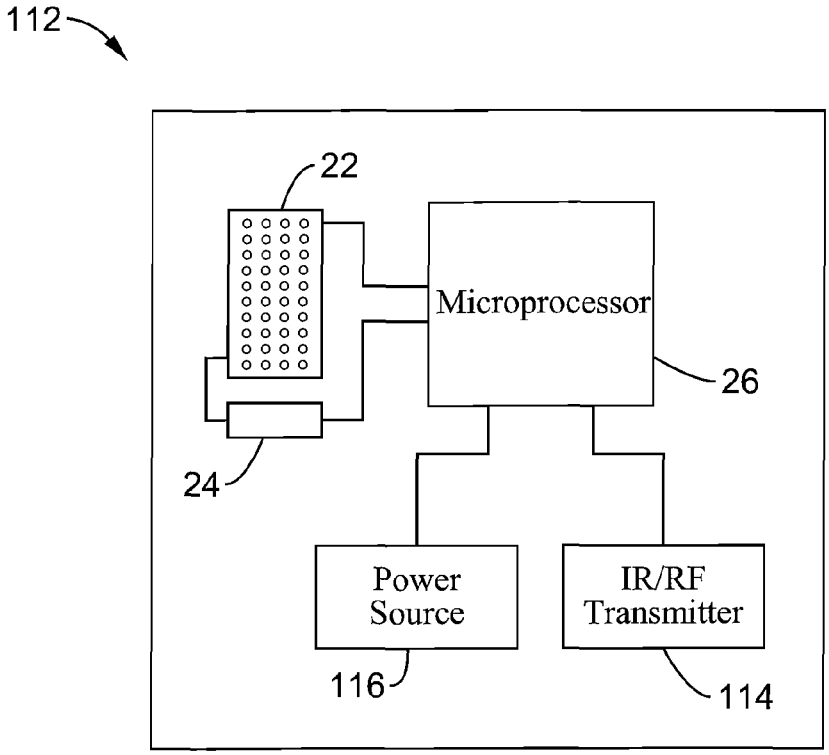

FIGS. 13A and 13B illustrate use of multiple remote sensing arrays used to map spray deposition of a region of interest, such as a tree.

Figure 14:
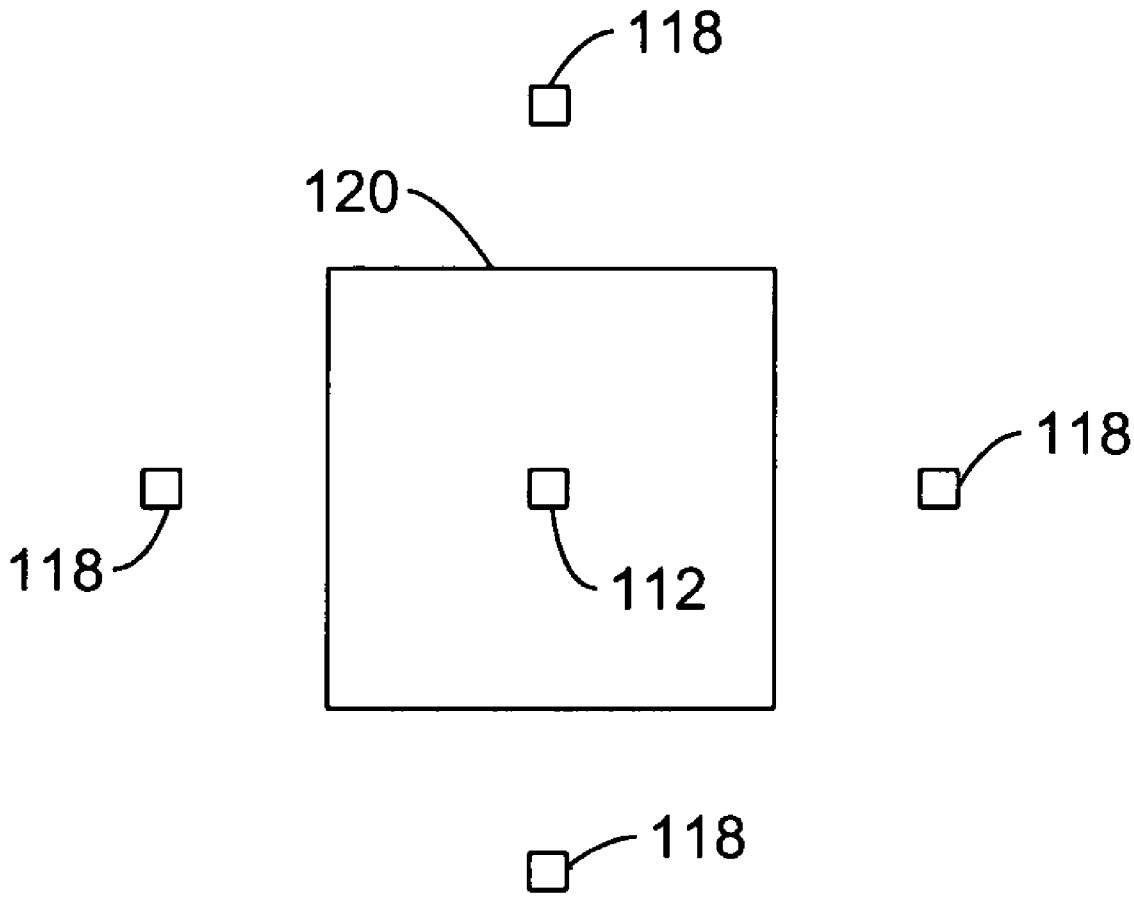

FIG. 14 shows use of remote sensing units as an end-user alarm of spray deposition outside a permissible area.

DETAILED DESCRIPTION OF THE INVENTION

Referring more specifically to the drawings, for illustrative purposes the present invention is embodied in the apparatus generally shown in FIG. 1 through FIG. 14. It will be appreciated that the apparatus may vary as to configuration and as to details of the parts, and that the method may vary as to the specific steps and sequence, without departing from the basic concepts as disclosed herein.

Referring to FIG. 1, the electronic spray sensory system 20 of the present invention comprises a sensor surface 22, comparator circuit 24, microprocessor 26 and display 32. The sensor surface 22 was constructed by filling 15 holes 40, of an electronic prototyping board 42, with single-sided solder pads, with electrical solder. As would be appreciated by one skilled in the art, the sensor surface 22 may be constructed from a variety of means to generate an array, such as an etched silicon wafer. As illustrated in FIG. 1, a 5 row×3 column pattern was selected as the array pattern. However, any number of rows or columns may be used to define the array of the present invention. The array may also be positioned in a variety of other orientations. For example, the center point of a 3-by-3 grid might be the source, while the surrounding 8 points would be the sensory points.

After filling the holes 40, the surface 22 of the prototyping board 42 is sanded or machined to produce a flat surface, leaving circular electrically-conducting pads 30 and 28 approximately 1.9 mm in diameter and 2.5 mm center-to-center spacing (visible in FIG. 4, discussed below). Each pad 28 of the first, third and fifth rows (pads 1, 2, 3, 7, 8, 9, 13, 14 and 15) are designated as "sensor pads" and are electrically connected individually to voltage comparator circuit 24. Pads 30 in the second and fourth rows (pads 4, 5, 6 and 10, 11, 12) are designated as "excitation pads" and are electrically joined and connected to the two analog output 36 (digital-to-analog converter, DAC) channels of a microprocessor 26, with diodes 38 inline. Because the analog output channels of the microprocessor were able to source or sink 5 mA, the diodes 38 ensure that electrical shorts between pads 30 in rows 2 and 4 on the sensor surface 22 don't allow current to flow between DAC channels 36.

Figure 1B:
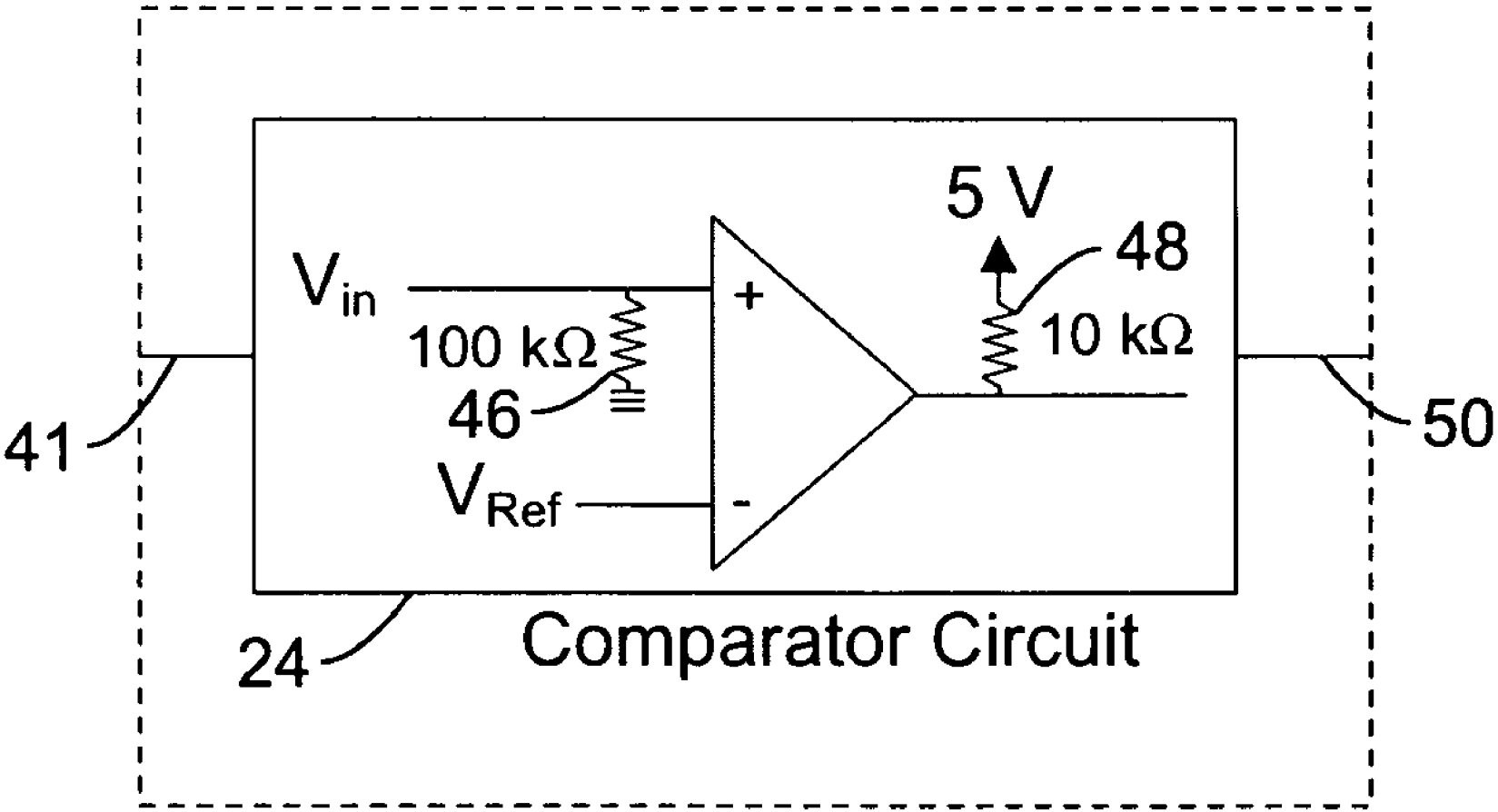
FIG. 1B is an expanded view of one of the comparator circuits of FIG. 1A.

Referring now to FIG. 1B, each sensor pad 28 in the first, third and fifth rows was connected via lead 41 to the positive input terminal ($V_{in}$) of the comparator circuit 24 (LM339), with a 100-kΩ pull-down resistor 46. A common reference voltage ($V_{ref}$) was supplied to all of the negative terminals of the comparator circuits 24. The output terminals of the comparator circuits were connected to 10-kΩ pull-up resistors 48 and digital input channels 50 of the microprocessor 26. The output from each comparator circuit was a TTL logic hi when $V_{in}$ was greater than $V_{ref}$, while the low logic state was output otherwise.

The microprocessor 26 (TD 40, Tern Inc., Davis, Calif.) had 24 digital input/output (I/O) channels and 2 analog output channels 36. The digital I/O lines were configured to function as 2 groups: 12 input lines 50 and 12 output lines 52. Nine of the digital input lines 50 received signals from the comparator circuits. Each digital output line 52 was connected to a light-emitting diode (LED) 34 on the LED display 32 and was able to illuminate individual LEDs 34 by sinking current from a source embedded on the LED display 32. The LED display 32 was chosen to visually indicate the output from the spray sensor 22 during evaluation of the system. The output from the sensor 22 may also be transmitted and archived as data for further processing by a computer. In addition, other display means, such as an LCD or CRT display, may be used to provide real-time display of the sensor array. For example, the system may perform additional processing to display statistics that describe the spray quality, e.g. volumetric mean diameter, etc.

In an alternative embodiment, the sensor surface 22 may be roughened, e.g. by bead-blasting or micro-abrasion, to better mimic the surface of a leaf or other target surface. The roughened surface may also serve to minimize spread of a droplet on the surface, thereby affecting even finer resolution of the sensor surface. The surface may be optimized to match the surface tension of the sprayed liquid or the contact angle of the sprayed liquid-deposition surface combination being monitored.

Figure 2:
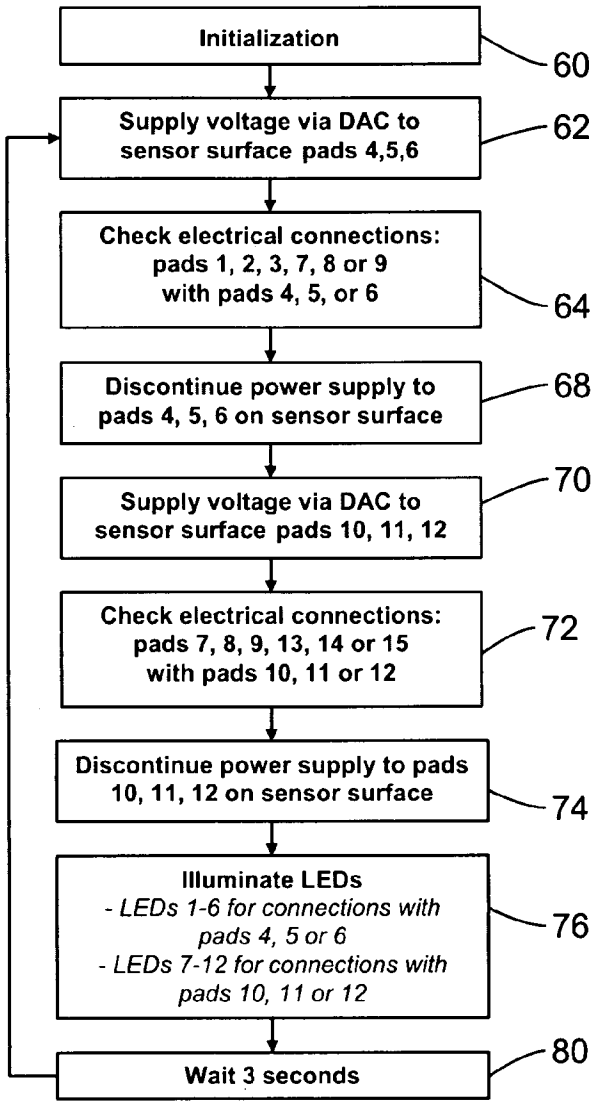
FIG. 2 is a flow diagram of the tasks executed by the microprocessor while sensing the spray deposition on the sensor surface.

Referring now to FIG. 2, a scanning program, such as a C++ software program, may be used to control the microprocessor 26, supply voltage to the sensor surface 22, and sense the digital response from the comparator circuit 24 to indicate the response via the LED display 32. FIG. 2 shows a flowchart of the tasks that an exemplary microprocessor 26 performs to interface the sensor surface 22 and comparator circuit 24 with the display 32.

After the initialization step 60, the microprocessor supplies 4.1 V to the analog output channel connected to excitation pads 30 (4, 5 and 6) and 0.0 V to excitation pads 30 in the fourth row (pads 10, 11 and 12) of the sensor surface 22, as shown in step 62.

Figure 3A:
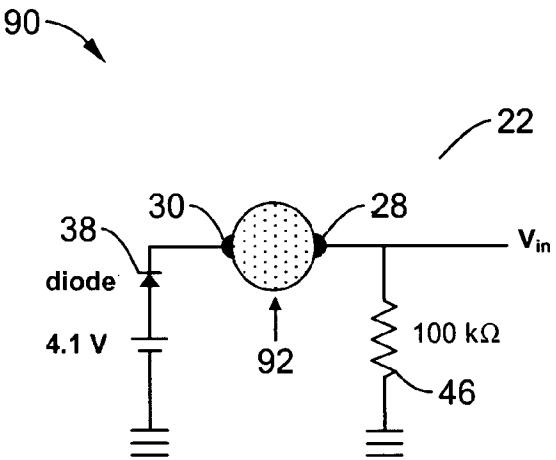
FIG. 3A is a schematic of a circuit on the sensor surface and FIG. 3B is an equivalent circuit as a result of the water deposition.
Figure 3B:
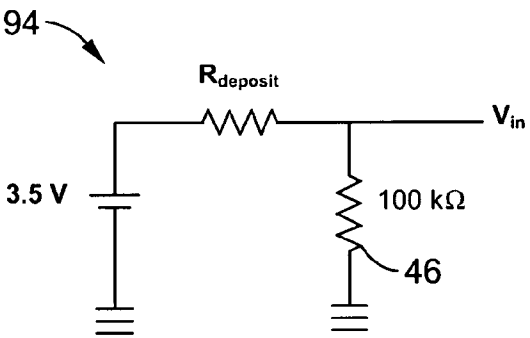

FIG. 3A illustrates a schematic of a circuit on the sensor surface and FIG. 3B is an equivalent circuit as a result of the water deposition. Fluid droplet 92 deposited on the sensor surface 22, connecting any excitation pad 30 in the second row with a sensor pad 28 in the first or third row (or any excitation pad 30 in the fourth row with a sensor pad 28 in the third or fifth row completes a circuit 90 to form equivalent circuit 94 shown in FIG. 3B. Equivalent circuit 94 consists of a 3.5-V source in series with the resistance of the fluid and a 100-kΩ resistor. A voltage drop of approximately 0.6 V occurs across the diode, resulting in potential of 3.5 V at the excitation pads 30 in the second row. Assuming that the voltage comparator had infinite input impedance, the levels of voltages supplied to the comparator circuits, $V_{in}$, are characterized by $$V_{in}=[100{,}000/(100{,}000+R_{deposit})]\times 3.5,$$

where: $R_{deposit}$ is the electrical resistance of the water deposit 92 connecting the sensing pad 28 and excitation pad 30 on the sensor surface 22. Rearranging equation 1, the maximum deposit resistance, $R_{deposit\text{-}max}$, that will result in a high logic output from the comparator circuit ($V_{in}=V_{ref}$), given the reference voltage, $V_{ref}$, was given by $$R_{deposit\text{-}max}=350{,}000/V_{ref}-100{,}000.$$

Thus, the maximum fluid resistance that will generate a logic high output from the comparator circuit is approximately 1.3 MΩ and 600 kΩ when $V_{ref}$ is 0.25 V and 0.5 V, respectively. Functionally, the reference voltage in the comparator circuits serves as a means to adjust the sensitivity of the sensory system.

Referring back to FIG. 2, in step 64 the microprocessor 26 scans and archives the output signals from the comparator circuits using the input voltages from sensor pads 1, 2, 3, 7, 8 and 9. A digital high signal associated with either of these inputs is interpreted to indicate that fluid has connected the sensing pad 28 with an excitation pad 30.

The microprocessor 26 then disconnects power to excitation pads in row 2, as shown in step 68. In step 70, 4.1 V is supplied to excitation pads 10, 11, and 12 in row 4. The digital input lines 50 are scanned again in step 72 to sense and archive the output signals from the comparator circuits that used input voltages from sensing pads 7, 8, 9, 13, 14 and 15. All power to the sensing surface 22 is then disconnected in step 76 before displaying the results of the scans by illuminating the relevant LEDs in step 76. The microprocessor waits for a specified period of time at step 80 before repeating the process at step 62. For the test unit described below, the microprocessor 26 waited 3 seconds before repeating the scanning and display procedures. The 3-second delay was an arbitrary duration and was implemented to retard the polarization of the fluid deposited on the sensor surface.

Referring back to FIG. 1, one or more high temperature heaters 31 may be coupled to the sensor board 22 and cycled to burn off any deposit of liquid between sample runs. With a thin circuit board, there is a low thermal mass, so a heater, such as a nichrome wire heater, would quickly reach the high temps necessary to evaporate the spray liquid and cook off any contaminates. The heater burn off may be done as part of a start up process or measurement cycle. Any debris on the sensor array that is not burned off would be sensed and may be masked out of any calculation of the spray deposit that subsequently occurs and is measured. In that sense, the sensor would be self cleaning (some spray liquids might leave a residue or debris) and whatever was left after cleaning would be subtracted away from any subsequent spray deposition events. Prior to the heating cycle, the microprocessor could also activate a valve (not shown) that would flush the sensor surface with a cleaning solution.

The LED display 32 shown in FIG. 1 consists of 12 light-emitting diodes 34. However, it would be appreciated to one skilled in the art that any number of LEDs may be used to correspond to the number of sensing pads and excitation pads on sensing surface 22. Diodes 1, 2, 3, 4, 5 and 6 were used to indicate that fluid had formed a current-conducting path between excitation pads 30 in row 2 and sensing pads 1, 2, 3, 7, 8 and 9, respectively. Current flowing from excitation pads 30 in the fourth row to sensing pads 7, 8, 9, 13, 14 and 15 was indicated by illuminating LEDs 7, 8, 9, 10, 11 and 12, respectively.

The resulting output of display 32 serves as a map or "footprint" of the spray liquid deposition on the sensor surface 22. Thus a graphical output of the deposition pattern on the sensor surface 22 may be used to indicate or locate regions not effected by spray, as well as regions being over-sprayed.

Figure 4:
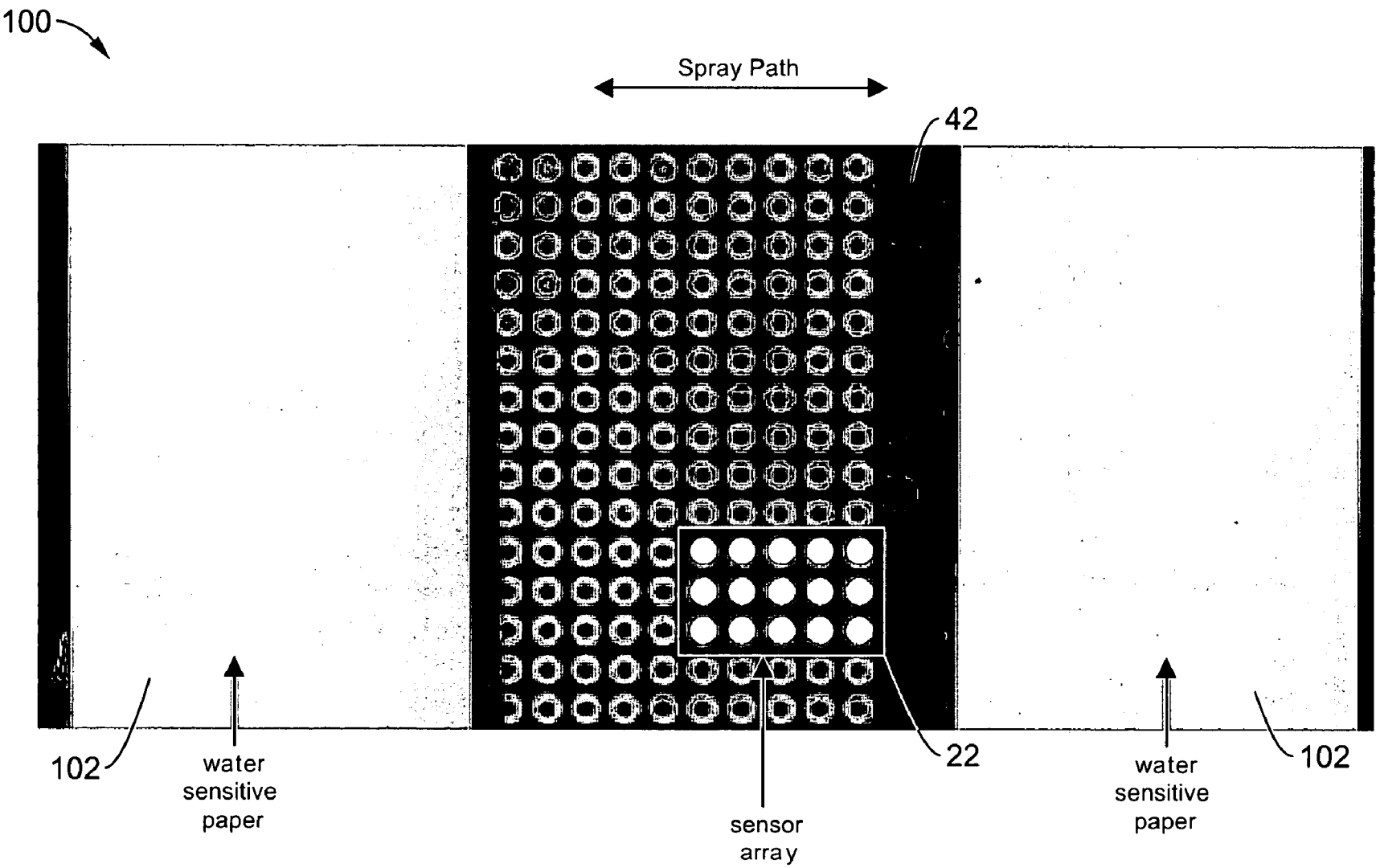
FIG. 4 illustrates the test configuration of the sensor with water-sensitive paper on each side of the sensor.

FIG. 4 illustrates the test setup 100 of the sensor surface 22 to evaluate the performance of the system. Liquid was sprayed from a pressurized hand-held applicator on to the sensor surface 22, and the resulting output (lights illuminated on the LED display 32) was videotaped. Further, indication of the deposition of droplets in the vicinity of the sensor surface 22 was produced by placing 26×76 mm pieces of water-sensitive paper (WSP) 102 adjacent to the sensor surface 22, collinear with the path of the spray applicator. After spray treatment, the WSP cards 102 were allowed to dry and the stains were analyzed using procedures described by Giles and Downey (2003).

Consistent with standards established by the ASAE (2004), coarse, medium, and fine spray was applied to the sensor surface, using 8008, 11006 and 11003 nozzles (Tee Jet, Spraying Systems Co., Wheaton, Ill.) with fluids pressurized to 250, 200 and 300 kPa, respectively. Two solutions were tested: a) municipal water (electrical conductivity=426 mS/cm) and b) a 0.1% solution of surfactant (Surfynol® TG-E) and municipal water (electrical conductivity=490 mS/cm). For each combination of nozzle and spray formulation, the reference voltage for all comparator circuits was set at 0.25 or 0.5 V. The experiment factors were droplet size class (3 levels), fluid (2 levels) and reference voltage (2 levels)

Four replicates of single passes for each nozzle-fluid-reference voltage combination were completed. FIG. 4 shows a photograph of the sensor surface 22 positioned on electronic prototyping board 42 between 2 pieces of WSP 102 prior to applying the fluid.

Figure 5:
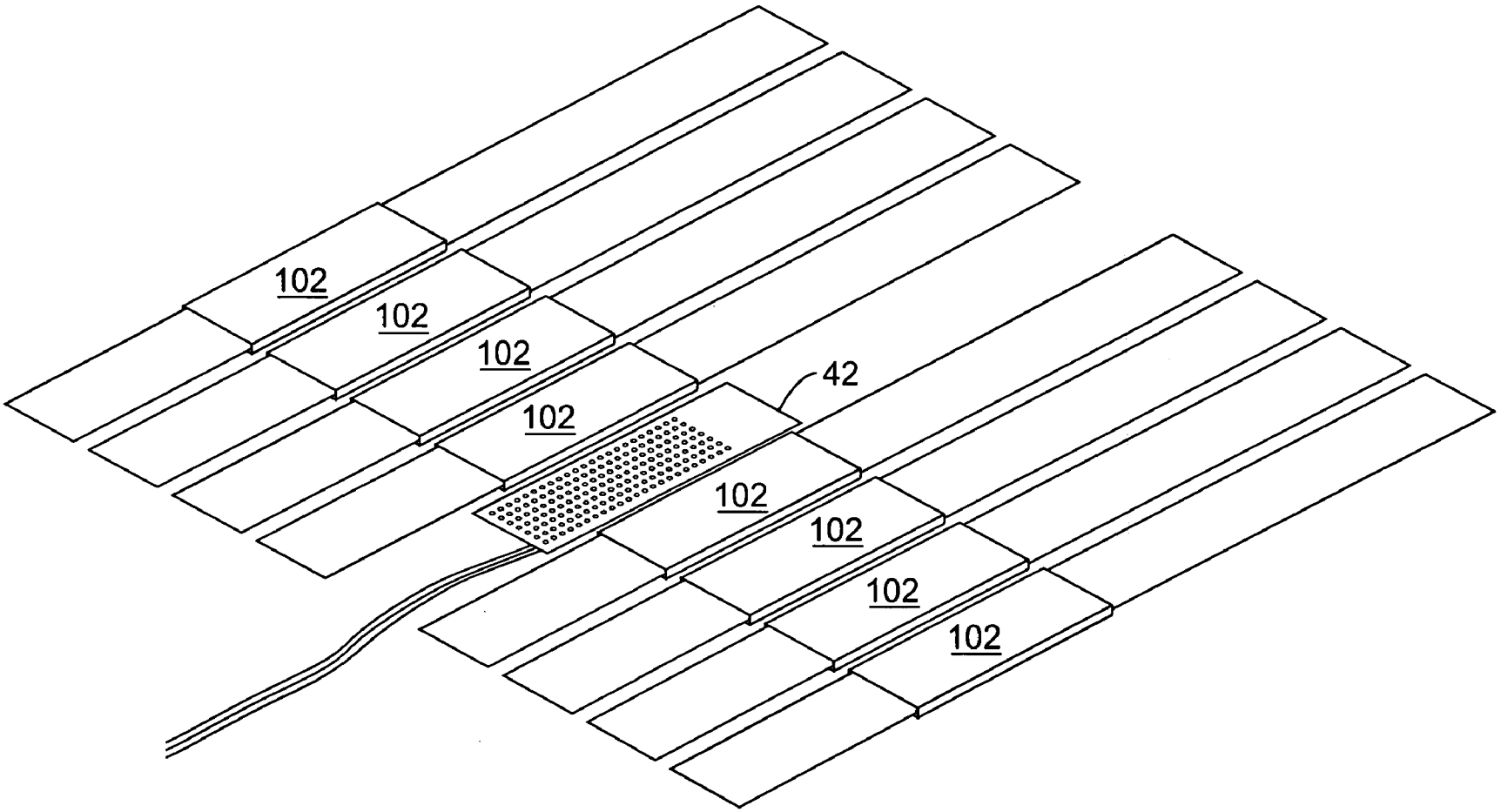
FIG. 5 illustrates another view of the test configuration with four sheets of water-sensitive paper on each side of the sensor.

To assess the system's response to greater deposition using the same spray quality (as defined by the ASAE droplet size spectrum classes), response of the system after multiple passes of the spray applicator was recorded. In these tests, four pieces of WSP 102 were positioned on each side of the sensor area, as illustrated in FIG. 5. After each pass of the applicator, the outer-most pair of WSP cards 102 was removed, until the final pair of cards had received spray from 4 passes of the applicator. In total, 96 pairs (3 droplet size classes, 2 reference voltages, 2 solutions and 8 application quantities: 5 single passes, 3 multiple passes) of WSP cards were sprayed and analyzed.

Each WSP card 102 was sub-sampled over a 25×25 mm area, and post-processing of images tabulated the number of stains, total stain area and portion of area stained. Because the sensing pads were separated from a source pad on the sensor surface by at least 0.6 mm, any stain smaller than 0.283 $mm^2$ (the area of a circle with diameter of 0.6 mm) was removed from further analysis. The average portion of the area stained on pairs of water-sensitive cards, and the number of LEDs illuminated, determined by reviewing the video tape, for each of the test conditions were compared.

Figure 6:
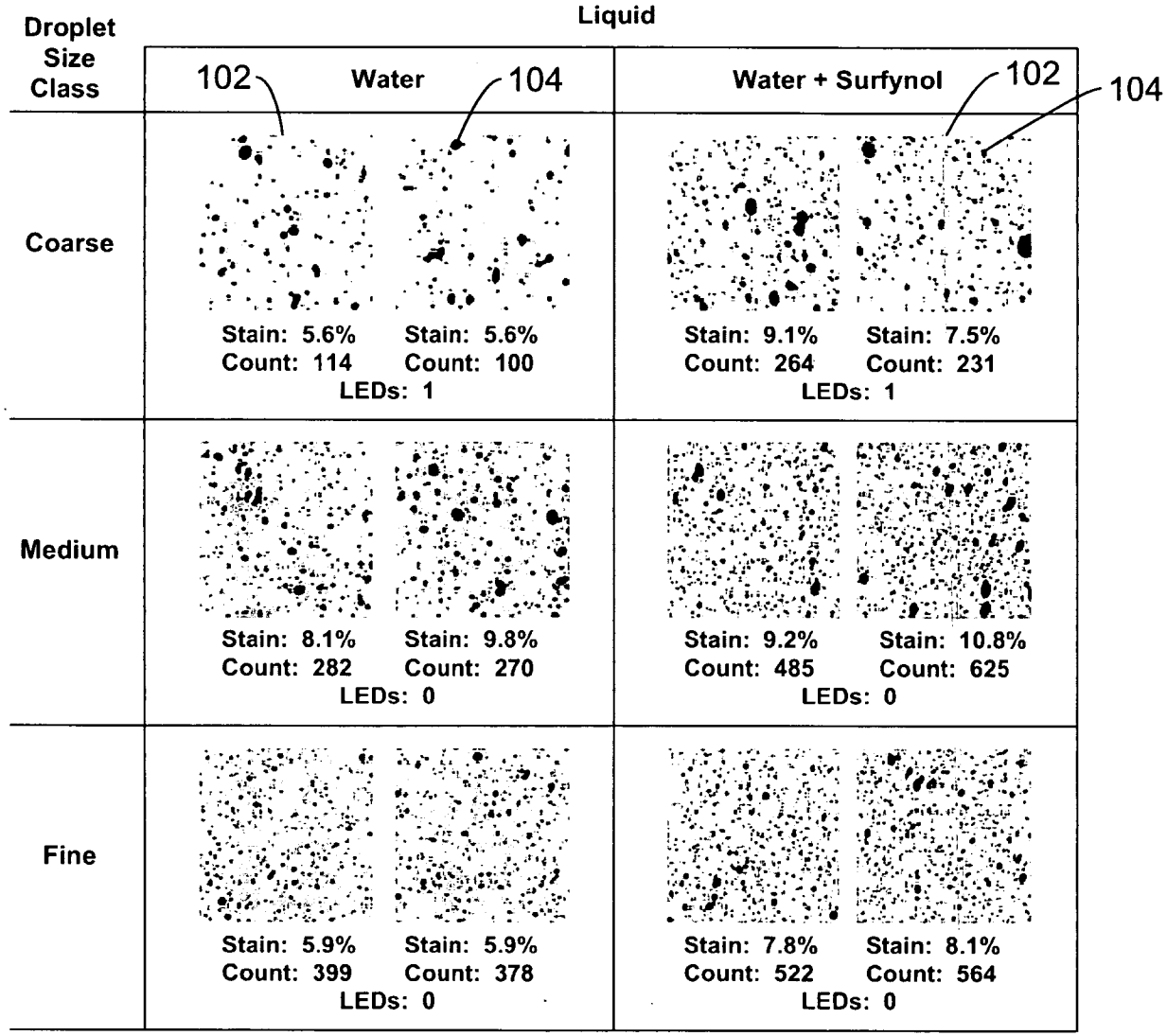
FIG. 6 shows the test samples illustrating the deposition pattern of fine, medium and course droplets for water and water and surfynol mixture.

FIG. 6 shows samples of WSP cards 102 after applications with coarse (8008 nozzle), medium (11006 nozzle) and fine (11003 nozzle) spray of water and the water-surfactant mixture with a 0.25 V comparator reference voltage. Generally, the coarse spray resulted in fewer and larger stains 104 than those on cards sprayed with medium and fine sprays. The addition of the surfactant tended to increase both the stain count and the portion of the area stained. These additional stains tended to be smaller. FIG. 6 also illustrates the effect of stain (droplet) size on the performance of the sensor. Although the area stained with the coarse spray was less than the area covered by medium spray, one LED was illuminated after both (water and water-surfactant mix) applications of coarse spray, but none of the LEDs were illuminated after applying the medium or fine spray.

Figure 7:
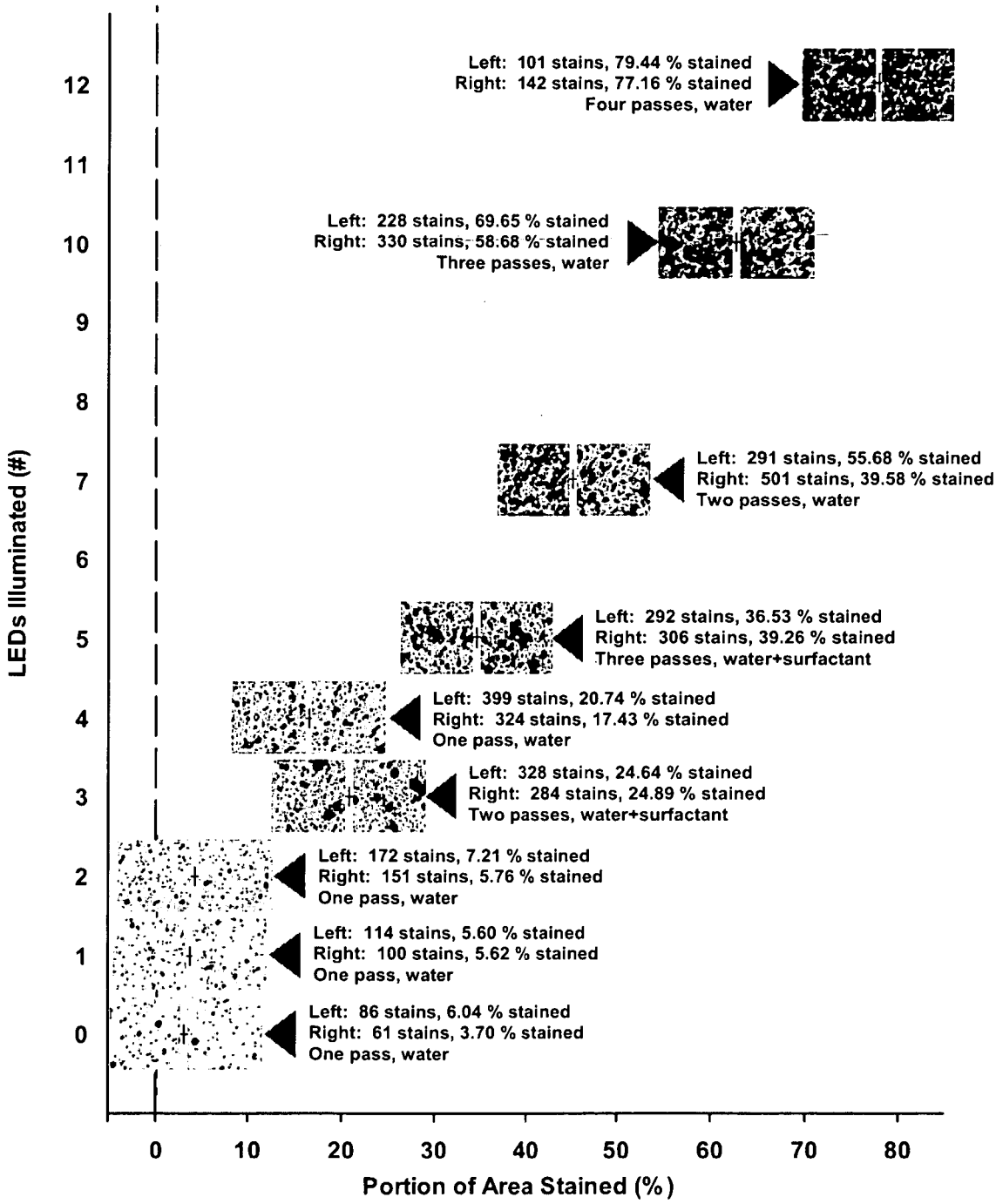
FIG. 7 illustrates the deposition patterns of the WSP cards with respect to the number of LED's illuminated and percent of area stained.

While FIG. 6 presents data concentrated at the lower end of the working range of the sensor, FIG. 7 presents a wider range of spray deposition and sensor response. Table 1 shows characteristics of the sampled areas from all WSP cards after single spray applications and after excluding the small (area less than 0.283 mm2) stains. Generally, the portion of the card 102 that was stained by the coarse-spray applicator was greatest, followed by the medium and fine spray applicators, respectively. There was no distinct trend in the number of stains within the sampled areas, except that the stain count after application of coarse and medium spray was greater than the stain count on cards sprayed with the fine spray. The mean stain area, calculated by dividing the stained area by the number of stains, showed expected trends, with coarse spray covering slightly more than 1 $mm^2$ per stain, medium spray covering approximately 0.7 $mm^2$ per stain and fine spray covering approximately 0.6 $mm^2$ per stain. The stains tended to be variable in consistency and uniformity, and this was attributed to the method of application and environmental conditions. The tests were conducted in an outdoor environment, and the fluids were sprayed from a pressurized container by manually sweeping the applicator across the cards and sensor surface, from side to side. Variations in orientation and height of the applicator relative to the sensor and WSP cards as well as the speed of the applicator and wind velocity caused the stain patterns to vary.

As shown in FIGS. 6 and 7, spraying the sensor surface 22 with the water-surfactant mix did not prompt an appreciably different response from the system when compared to the response of the system to deposited water, alone. The addition of surfactant resulted in more small stains 104 on the water-sensitive cards 102, but these additional droplets tended to be very small and didn't result in more contact closures on the sensor surface 22 because of the relatively large spatial separation of pads 28,30 on the sensor surface 22.

Figure 8A:
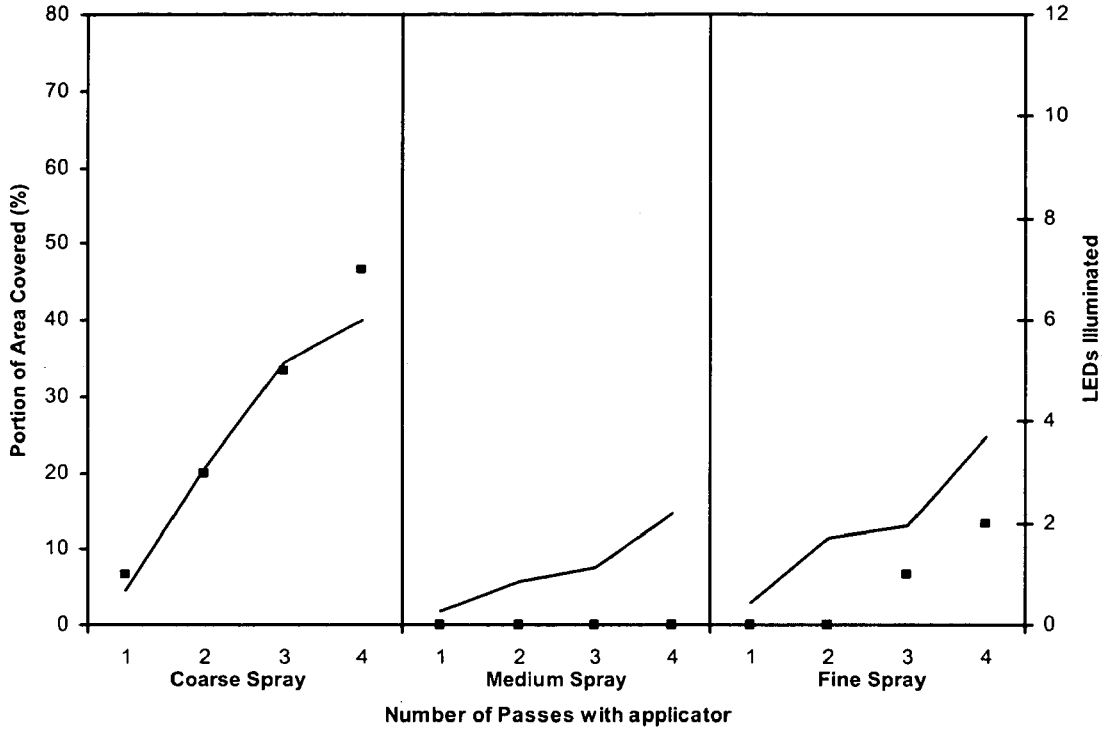
FIG. 8A illustrates the test results for the course, medium and fine sprays of water-surfactant mix on the water-sensitive cards with a 0.25V reference voltage in the comparator circuit.
Figure 8B:
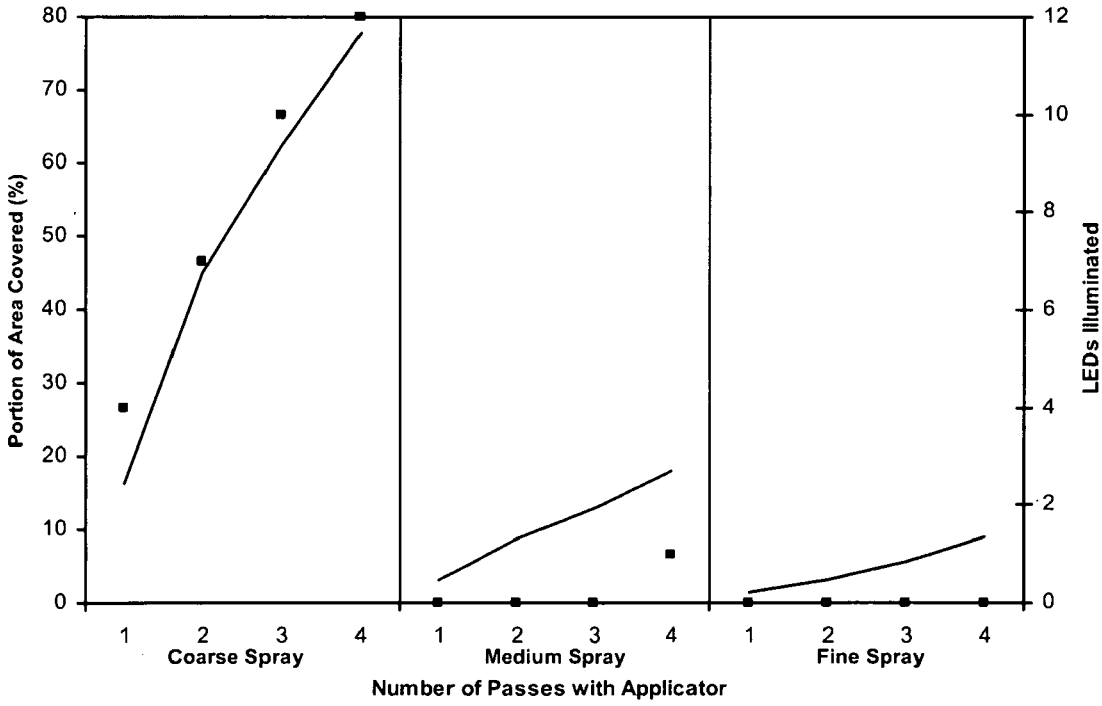
FIG. 8B illustrates the test results for the course, medium and fine sprays of water on the water-sensitive cards with a 0.25V reference voltage in the comparator circuit.
Figure 9A:
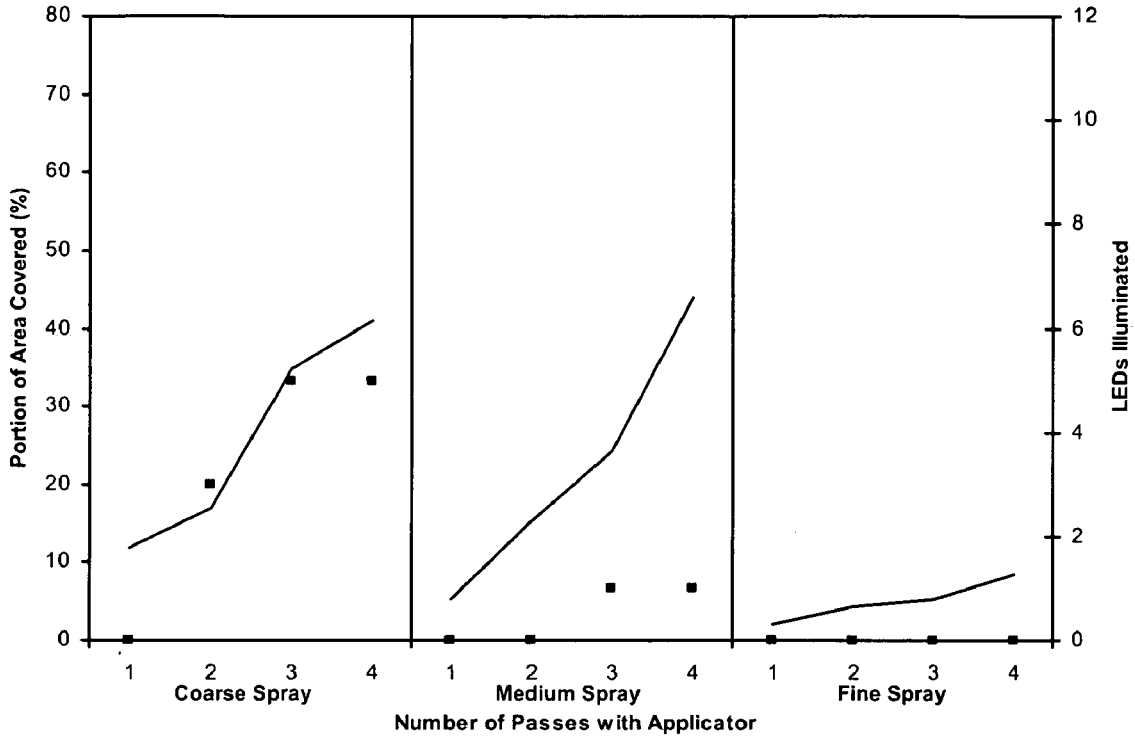
FIG. 9A illustrates the test results for the course, medium and fine sprays of water-surfactant mix on the water-sensitive cards with a 0.5V reference voltage in the comparator circuit.
Figure 9B:
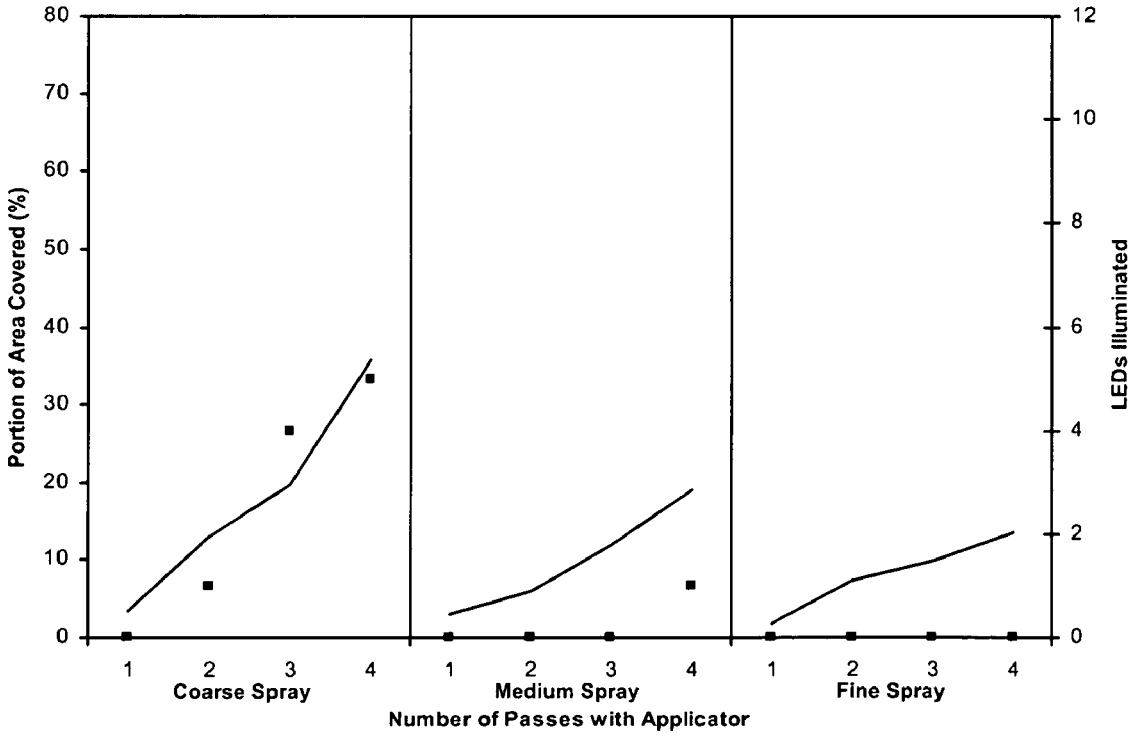
FIG. 9B illustrates the test results for the course, medium and fine sprays of water on the water-sensitive cards with a 0.5V reference voltage in the comparator circuit.

FIGS. 8A-B and 9A-B show results from tests conducted with multiple passes of the spray applicators to show the performance of the system in response to greater fluid deposits on the sensor array 22. In FIGS. 8A-B and 9A-B, the discrete points indicate the number of LEDs that were illuminated and correspond to the value in the right-hand vertical axis, whereas the continuous line indicates the portion of area covered as called out in the left-hand vertical axis. FIGS. 8A-B show the results when the comparator reference voltage was set at 0.25 V, while data in FIGS. 9A-B were derived from tests conducted with the reference voltage set at 0.5 V. FIGS. 8A and 9A illustrates results from sprays consisting of a water-surfactant mixture, while FIGS. 8B and 9B show results from sprays consisting of water only. Data in both FIGS. 8A-B and 9A-B illustrate the effect of droplet size on the performance of the sensor system, with coarse spray producing the most consistent responses. The number of LEDs illuminated after a similar deposition of medium or fine sprays was consistently less than the number of LEDs illuminated when coarse spray was deposited. Further, equal deposition of coarse spray resulted in more LEDs being illuminated when the reference voltage in the comparator circuit was 0.25 V, as opposed to 0.5 V, and this was consistent with the expectation that a lower reference voltage would increase system sensitivity.

FIGS. 10A-C and 11A-C show the combined responses of the sensor after single and multiple applications, with the comparator reference voltage set at 0.25 and 0.5 V, respectively. These plots reinforce the information presented in FIGS. 8 and 9. Specifically, the system was most responsive to coarse spray, and it was increasingly less responsive to the medium and fine sprays, respectively. Curves of the following form:

$$Y=1-\beta(\tau-x)$$

were fitted to the observed data and plotted in FIGS. 10A and 11A, where:

y=number of LEDs illuminated (0-12, integer),

β=sensitivity of sensor (LEDs illuminated/sensor area stained in %),

τ=detection limit (area stained in % for y=1 LED illuminated) and x=area stained (% of area analyzed).

The above equation was used to allow the prediction of the minimum detectable level, τ, on the sensor surface. The 95% confidence limits of the τ estimate were 5.4±3.0% and 9.9±3.1% when the comparator reference voltage was 0.25 V and 0.5 V, respectively. These differences were consistent with the expectation that the sensor was more sensitive when a lower reference voltage was used in the comparator circuits. Further, the reciprocal of the slopes of the 2 lines (6.7% area covered per LED illuminated) represented the incremental amount of area stained that was required to cause an incremental increase in the number of LEDs illuminated. This does not suggest that a single stain of 43 $mm^2$ (6.7% of the sampled area) was required to illuminate 1 LED. Rather, the effects of random positioning of large droplets and coalescing smaller droplets combined to affect the incremental change in the output. In addition, the slope of these regression curves was largely affected by spatial resolution on the sensor surface 22, and thus spatial density of the pads may be increased to increase the slope of these curves, thereby increasing the sensitivity of the system.

It is also evident that the number of LEDs illuminated is a discrete variable, i.e. it's impossible to have a fraction of an LED illuminated. Thus, a theoretical plot having an abundance of data would resemble FIG. 12. Data previously presented illustrate that the number of LEDs illuminated is related to the portion of adjacent areas stained. However, it's reasonable to expect, as is illustrated in FIG. 11, that different numbers of LEDs could be illuminated, given a single area stained. Creation of deposition maps on the sensor surface may be achieved by increasing the spatial resolution of the sensor pads and by performing more detailed scans of the sensor array.

There were a number of implicit assumptions in the analyses of these data, specifically when considering the stains on the WSP cards and the associated deposition on the spray sensor. Stains on the WSP cards were intended to document the coarseness of the spray and supported speculation about the related deposition on the spray sensor. The spread factor (ideal spherical droplet diameter/deposited droplet diameter on a flat surface) on WSP has a typical value of 0.39 (Giles and Downey 2003), however the spread factor on the sensor array is unknown. It was assumed that the WSP cards provided an accurate indication of the deposition pattern of spray on the sensor surface, despite their being positioned at the sides of the sensor during spray deposition and differences in how the WSP and sensor surface interacted with the spray droplets.

The test data supported the claim that the system was most responsive to coarse spray. This is a predicable result given the format and construction of the sensor surface. A droplet or coalesced droplets must form a path of fluid from an excitation pad 30 to a sensing pad 28 on the sensor surface 22 in order for the system to sense a droplet and illuminate an LED. In the present test setup, the pads on the sensor surface 22 are far apart, relative to the size of individual droplets, especially in the case of the medium and fine sprays. A finer grid or array of excitation and sensing pads on the sensor surface 22 would make the system more responsive to medium and fine sprays.

Under the test configuration of FIG. 4, the sensing surface 22 was scanned in a single direction, disregarding droplets that may have connected sensing pads within the same row. However, alternate scanning techniques, e.g. column vs. rows, may be readily employed to detect the presence of droplets on the sensor surface. Furthermore, the scanning software could employ additional logic to further develop the deposition "footprint" of fluid on the sensor surface to more accurately detect deposition rates. With an accurate map of fluid deposition on the sensor, mass deposition rates may also be recorded. In addition, AC excitation of the sensor array may be used to eliminate polarization of the spray deposit.

The ability to electronically sense spray deposition has a variety of applications, most prominently in the area of pesticide application research. As shown in FIG. 13A and 13B, multiple portable deposition sensor units 112 configured with sensor arrays 22 may be displaced within a target region 110, such as a tree. The sensor units may have independently powered wireless transceivers 114, such as an IR or RF transmitter, and be networked via wireless communication to a remote processing unit 115 having a corresponding receiver. The remote processing unit 115 may be mounted in a mobile vehicle, or be at a stationary site in proximity of the target region 110. To save on power consumption of the power source 116, the transmitter 114 may be configured to only transmit to the remote unit upon a positive reading from the sensor array 22.

This portable deposition sensor 112 may be particularly useful for testing equipment performance and characteristics, and pesticide movement and deposition. Equipment may be tested for real-time analysis of performance on particular regions of the tree. For example, the portable sensors 112 may indicate that the upper or inner regions of the tree 110 have a lower deposition rate than sensor readings in the lower regions.

Referring to FIG. 14, remote deposition sensors 118, may also be used as an end-user alarm to indicate in situ when spray is detected outside a permissible spray region 120, e.g. by a strong wind impermissibly carrying the spray out of the region 120 unbeknownst to the end-user. The portable detectors may be placed outside region 120, such that spray readings by the sensors 118 warn the end-user to cease spraying the field until conditions improve.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

TABLE 1

Summary of mean size and number of stains on water-sensitive cards after single passes of the spray applicator

| Fluid | Spray Type | Portion Stained (%) | Stain Count | Mean Stain Area ($mm^2$ per stain) |
|---|---|---|---|---|
| Water | Coarse | 6.4 | 40 | 1.02 |
| | Medium | 6.1 | 53 | 0.73 |
| | Fine | 2.9 | 35 | 0.54 |
| Water + surf | Coarse | 7.7 | 43 | 1.16 |
| | Medium | 4.0 | 36 | 0.71 |
| | Fine | 3.0 | 29 | 0.65 |

What is claimed is:

1. An apparatus for sensing deposition of sprayed droplets of liquid on a surface, comprising:

a sensing surface;

the sensing surface comprising a plurality of electrically conductive elements disposed across the sensing surface;

wherein the conductive elements are closely spaced apart from each other and electrically insulated from each other on the sensing surface; and at least one comparator circuit coupled to the conductive elements;

the comparator circuit configured to detect the presence of liquid at the conductive element;

wherein the conductive elements are disposed in an array across the sensing surface such that information regarding the presence, distribution, deposition density, size, and location of the sprayed droplets of liquid on the sensing surface may be determined; and wherein a deposition map and summary data of the sprayed droplets of liquid may be produced from said information.

2. An apparatus as recited in claim 1:

wherein the sensing surface comprises at least three conductive elements; and wherein the conductive elements are configured such that deposition of liquid across two of the conductive elements causes a change in voltage detectable by one of said comparator circuits;

said change in voltage signaling the presence and location of liquid on said sensing surface.

3. An apparatus as recited in claim 2, further comprising:

a microprocessor coupled to the conductive elements and the comparator circuits;

said microprocessor configured to scan the conductive elements for deposition of liquid at the conductive elements.

4. An apparatus as recited in claim 3, further comprising:

a display coupled to the microprocessor;

said display responsive to output from said microprocessor to indicate the presence and location of liquid at said conductive elements.

5. An apparatus as recited in claim 4:

wherein the display comprises a plurality of LEDs;

each LED corresponding to output from a conductive element; and wherein the LED illuminates as a result of liquid deposition at the conductive element.

6. An apparatus as recited in claim 5:

wherein the LEDs are arranged in an array such that the location of each LED corresponds to a location of the conductive element.

7. An apparatus as recited in claim 3, further comprising:

a transmitter coupled to the microprocessor;

said transmitter configured to transmit signals of the sensing surface to a remote unit;

said remote unit having a receiver adapted to receive the signals from said transmitter.

8. An apparatus as recited in claim 7, wherein said remote unit is configured to receive signals from a plurality of sensing surfaces.

9. An apparatus as recited in claim 7, wherein said remote unit is configured to display real-time output from said sensing surface.

10. An apparatus as recited in claim 2:

wherein the conductive elements comprise:

a plurality of sensing pads electrically connected to the comparator circuit; and a plurality of excitation pads each supplied with a voltage; and wherein deposition of water across one of the plurality of sensing pads and one of the plurality of excitation pads results in a change in voltage detectable by the comparator circuit.

11. An apparatus as recited in claim 10, wherein the sensing pads and the excitation pads are arranged adjacent to each other.

12. An apparatus as recited in claim 10:

wherein the comparator circuit is supplied with a reference voltage; and wherein the reference voltage controls the sensitivity of the sensing surface.

13. An apparatus as recited in claim 1, further comprising:

a heating element coupled to the sensing surface;

the heater configured to burn off liquid and debris from the sensor surface between measurements.

14. A method of detecting sprayed droplets of liquid on a sensor surface; comprising:

supplying voltage to at least a first portion of a plurality of electrically conductive elements disposed across the sensor surface;

checking at least a portion of the conductive elements for the presence of liquid droplet deposition at the conductive elements; and displaying the location of a conductive element having liquid droplet deposition;

wherein a plurality of said displayed locations forms a deposition map of the sprayed droplets of liquid.

15. A method as recited in claim 14:

wherein a second portion of the plurality of conductive elements are not supplied voltage; and wherein checking at least a portion of the conductive elements comprises checking the second portion of conductive elements.

16. A method as recited in claim 15, wherein checking the second portion of conductive elements comprises checking a voltage of the second portion of the conductive elements with a comparator circuit.

17. A method as recited in claim 15, wherein checking a voltage of the second portion of the conductive elements comprises comparing a voltage input from a conductive element with a reference voltage supplied to the comparator circuit.

18. A method as recited in claim 17, further comprising:

controlling the value of the reference voltage to adjust the sensitivity of the sensor surface.

19. A method as recited in claim 15, wherein the sensor surface is configured such that deposition of liquid across one of the first portion of conductive elements and one of the second portion of conductive elements results in a change in voltage detectable by the comparator circuit.

20. A method as recited in claim 15, further comprising:

supplying voltage to a third portion of the plurality of conductive elements after discontinuing power to the first portion of conductive elements;

wherein the sensor surface is configured such that deposition of liquid across one of the third portion of conductive elements and one of the second portion of conductive elements results in a change in voltage detectable by the comparator circuit.

21. A method as recited in claim 14, wherein checking at least a portion of the conductive elements comprises scanning the portion of conductive elements with a microprocessor.

22. A method as recited in claim 14:

wherein displaying the location of a conductive element having water deposition further comprises displaying a map of the plurality of conductive elements;

the map comprising the locations of at least a portion of the conductive elements.

23. A method as recited in claim 22:

wherein displaying the location of a conductive element comprises illuminating a portion of the display to illustrate the presence of water deposition at the conductive element;

the illuminated portion of the display corresponding to the location of the conductive element.

24. A method as recited in claim 14, further comprising:

transmitting a signal from the sensor surface to a remote unit;

wherein the location of a conductive element having water deposition is displayed at the remote unit.

25. A method as recited in claim 24, wherein the signal is transmitted via a wireless transmitter.

26. A method as recited in claim 24, further comprising:

transmitting a second signal from a second sensor surface spaced apart from the first sensor surface to the remote unit; and displaying output from the second sensor surface at the remote unit.

27. A method as recited in claim 14, further comprising:

heating the sensor surface to burn off liquid and debris from the sensor surface between measurements.

28. An electronic spray deposition sensor, comprising:

a sensing surface;

the sensing surface comprising a plurality of electrically conductive elements disposed in an array across the sensing surface; and means for monitoring the plurality of conductive elements to determine the presence and location of deposition of sprayed liquid droplets on the sensing surface;

wherein a deposition map of the distribution and deposition density of the sprayed droplets of liquid and a numerical summary of the map information may be produced from said information.

29. A deposition sensor as recited in claim 28, wherein the means for monitoring the plurality of conductive elements comprises:

means for supplying voltage to at least a portion of the plurality of conductive elements; and means for checking the voltage of at least a portion of the plurality of the conductive elements.

30. A deposition sensor as recited in claim 29, wherein;

means for checking the voltage of the conductive elements comprises a microprocessor and a comparator circuit.

31. A deposition sensor as recited in claim 29, further comprising means for displaying the output signal from the sensor surface at the remote location.

32. A deposition sensor as recited in claim 28, further comprising means for displaying output from the sensor surface.

33. A deposition sensor as recited in claim 32, means for displaying output from the sensor surface comprises means for mapping the location of liquid deposition across the sensor surface.

34. A deposition sensor as recited in claim 28, further comprising means for transmitting an output signal from the sensor surface to a remote location.

* * * * *